US008682200B2

(12) United States Patent
Chadani et al.

(10) Patent No.: US 8,682,200 B2
(45) Date of Patent: Mar. 25, 2014

(54) PROCESS CARTRIDGE AND IMAGE FORMING APPARATUS

(75) Inventors: Kazuo Chadani, Suntou-gun (JP); Osamu Koyama, Numazu (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 13/096,467

(22) Filed: Apr. 28, 2011

(65) Prior Publication Data

US 2011/0280620 A1 Nov. 17, 2011

(30) Foreign Application Priority Data

May 14, 2010 (JP) ..... 2010-112208
Apr. 25, 2011 (JP) ..... 2011-097427

(51) Int. Cl.
*G03G 15/00* (2006.01)

(52) U.S. Cl.
USPC ..... 399/90; 399/111

(58) Field of Classification Search
USPC ..... 399/90, 111
See application file for complete search history.

(56) References Cited

U.S. PATENT DOCUMENTS

| | | | |
|---|---|---|---|
| 5,943,529 | A | 8/1999 | Miyabe et al. |
| 5,966,567 | A | 10/1999 | Matsuzaki et al. |
| 6,144,815 | A | 11/2000 | Chadani et al. |
| 6,173,140 | B1 | 1/2001 | Suzuki et al. |
| 6,173,145 | B1 | 1/2001 | Chadani et al. |
| 6,178,302 | B1 | 1/2001 | Nagashima et al. |
| 6,205,305 | B1 | 3/2001 | Suzuki et al. |
| 6,219,504 | B1 | 4/2001 | Matsuzaki et al. |
| 6,282,389 | B1 | 8/2001 | Matsuzaki et al. |
| 6,301,457 | B1 | 10/2001 | Chadani et al. |
| 6,473,585 | B2 | 10/2002 | Abe et al. |
| 6,512,903 | B2 | 1/2003 | Chadani |
| 6,535,699 | B1 | 3/2003 | Abe et al. |
| 6,671,474 | B2 | 12/2003 | Chadani |

(Continued)

FOREIGN PATENT DOCUMENTS

| | | |
|---|---|---|
| CN | 1728013 A | 2/2006 |
| JP | 2001-337511 | 12/2001 |

(Continued)

OTHER PUBLICATIONS

Office Action in Chinese Patent Application No. 201110128605.5, dated Jan. 30, 2013 (with English translation).

*Primary Examiner* — Benjamin Schmitt
(74) *Attorney, Agent, or Firm* — Fitzpatrick, Cella, Harper & Scinto

(57) ABSTRACT

A process cartridge detachably mountable to a main assembly of an image forming apparatus, the process cartridge includes a first unit provided with a photosensitive drum, and a second unit provided with a developer carrying member and connected with the first unit so as to be movable between a contact position in which the developer carrying member is contacted with the drum and a spacing position in which the developer carrying member is spaced from the drum. The second unit includes a first contact portion for contacting to a main assembly electrical contact and for receiving a first contact force therefrom, and a second contact portion for contacting to the main assembly electrical contact and for receiving a second contact force therefrom, to electrically connect with the main assembly electrical contact when the cartridge is mounted to the main assembly and the second unit is positioned in the contact position.

19 Claims, 18 Drawing Sheets

(56) References Cited

U.S. PATENT DOCUMENTS

| | | | | |
|---|---|---|---|---|
| 6,795,666 | B2 | 9/2004 | Miyabe et al. | |
| 6,823,155 | B2 | 11/2004 | Tsuda et al. | |
| 6,931,226 | B2 | 8/2005 | Chadani et al. | |
| 6,934,485 | B2 | 8/2005 | Miyabe et al. | |
| 6,980,759 | B2 | 12/2005 | Kanno et al. | |
| 7,136,604 | B2 | 11/2006 | Chadani et al. | |
| 7,184,682 | B2 | 2/2007 | Chadani et al. | |
| 7,421,225 | B2 * | 9/2008 | Yokoi | 399/90 |
| 7,433,622 | B2 | 10/2008 | Chadani et al. | |
| 7,499,663 | B2 | 3/2009 | Sato et al. | |
| 7,570,900 | B2 | 8/2009 | Chadani et al. | |
| 7,689,146 | B2 | 3/2010 | Sato et al. | |
| 7,761,024 | B2 | 7/2010 | Imaizumi et al. | |
| 7,890,012 | B2 | 2/2011 | Koishi et al. | |
| 7,890,025 | B2 | 2/2011 | Chadani et al. | |
| 7,899,364 | B2 | 3/2011 | Chadani et al. | |
| 7,907,866 | B2 | 3/2011 | Imaizumi et al. | |
| 2008/0292356 | A1 * | 11/2008 | Furuichi et al. | 399/112 |
| 2009/0297208 | A1 | 12/2009 | Suzuki et al. | |
| 2009/0297214 | A1 | 12/2009 | Chadani et al. | |
| 2009/0297215 | A1 | 12/2009 | Munetsugu et al. | |
| 2010/0329732 | A1 | 12/2010 | Chadani et al. | |
| 2011/0097108 | A1 | 4/2011 | Chadani et al. | |
| 2011/0123224 | A1 | 5/2011 | Chadani et al. | |

FOREIGN PATENT DOCUMENTS

| | | |
|---|---|---|
| JP | 2006-276190 | 10/2006 |
| JP | 2007-213018 | 8/2007 |
| JP | 2008-165023 | 7/2008 |

* cited by examiner (a)

(b)

(a)

(b)

(a)

(b)

(c)

(a)

(b)

(a)

(b)

PROCESS CARTRIDGE AND IMAGE FORMING APPARATUS

FIELD OF THE INVENTION AND RELATED ART

The present invention relates to an image forming apparatus having a function to form an image on recording medium such as a sheet of paper. It relates also to a process cartridge which is removably mountable in an image forming apparatus.

A process cartridge has long been used in the field of an electrophotographic image forming apparatus. A process cartridge is removably mountable in the main assembly of an electrophotographic image forming apparatus. It comprises: an electrophotographic photosensitive drum; one or more means for processing the photosensitive drum; and a shell (cartridge) in which the electrophotographic photosensitive drum and processing means are integrally placed. A process cartridge makes it possible for a user to maintain an image forming apparatus without relying on a service person. Thus, it can substantially increase an image forming apparatus in operational efficiency. This is why a process cartridge has been widely used in the field of an image forming apparatus. An electrophotographic image forming apparatus which employs a process cartridge has to, be enabled to make electrical connection between the process cartridge and its main assembly (for example, Japanese Laid-open Patent Application 2007-213018 (P.9, P.7, and FIG. 11) when voltage has to be applied to the charging member of a process cartridge to charge the electrophotographic photosensitive drum of the process cartridge, and when voltage has to be applied to the developing means of the process cartridge of the process cartridge to develop an electrostatic latent image formed on the electrophotographic photosensitive drum.

Some electrophotographic color image forming apparatuses of the so-called inline type employ multiple process cartridges which are aligned in parallel in the main assembly of the image forming apparatus. As the developing method usable by a process cartridge employed by an electrophotographic color image forming apparatus such as those described above, there area contact developing method and a non-contact developing method. A contact developing method is such a developing method that a development roller is placed in contact with an electrophotographic photosensitive drum in order to develop an electrostatic latent image on the drum. In the case of this developing method, a development roller has to be placed in contact with an electrophotographic photosensitive drum so that a preset amount of pressure is maintained between the roller and drum. Thus, during an image forming operation, the development roller is kept pressed upon the electrophotographic photosensitive drum. Therefore, if an electrophotographic image forming apparatus which employs a contact developing method is kept in a state in which the development roller is in contact with the electrophotographic photosensitive drum, for a substantial length of time, it is liable for the elastic layer of the development roller to be deformed by the pressure which it receives from the electrophotographic photosensitive drum. If the elastic layer of the development roller remains deformed, it is liable that the developed electrostatic latent image will suffer from nonuniformity in terms of density, the pattern of which corresponds to the rotational frequency of the development roller.

There have been proposed various solutions to this problem. One of these solutions is to provide an electrophotographic image forming apparatus and the process cartridge therefor with a mechanism for keeping the electrophotographic photosensitive drum and development roller separated while the apparatus is not being used for image formation (Japanese Laid-open Patent Application 2001-337511 (P.5, P.6, and FIG. 2), for example). Another of these solutions is to provide an electrophotographic image forming apparatus and the process cartridge therefor with such a mechanism that keeps the development roller of the process cartridge separated from the electrophotographic photosensitive drum of the process cartridge until the process cartridge is mounted into the main assembly of an image forming apparatus, and then, places the development roller in contact with the photosensitive drum as the process cartridge is mounted into the main assembly of the image forming apparatus (Japanese Laid-open Patent Application 2006-276190 (for example, P.9-P.11, FIGS. 6-8)).

SUMMARY OF THE INVENTION

However, the conventional structural solutions, such as those described above, to the problem suffer from the following problems. That is, when a development roller is placed in contact with an electrophotographic photosensitive drum, a process cartridge comes into contact with the electrical contacts of the main assembly of an electrophotographic image forming apparatus. Thus, if the amount of pressure applied to keep the development roller in contact with the electrophotographic photosensitive drum is small, it is liable that the friction between the process cartridge and the electrical contacts of the electrophotographic image forming apparatus prevents the development roller from remaining properly in contact with the electrophotographic photosensitive drum. Thus, in the case of the structural solutions such as those described above, the pressure applied to keep the development roller properly in contact with the photosensitive drum had to be substantial. However, increasing the amount of pressure between the development roller and electrophotographic photosensitive drum resulted in increase in the amount of load to which the mechanism for keeping the development roller and photosensitive drum separated from each other is subjected while the image forming apparatus was on standby. Thus, the mechanism for keeping the development roller and photosensitive drum separated from each other had to be increased in strength. The present invention was made in consideration of problems such as those described above, Thus, the primary object of the present invention is to provide a process cartridge, the image bearing member and developer bearing member of which are separable from each other, and which is more stable in the state of contact between the image bearing member and developer bearing member than any of the process cartridge in accordance with the prior art, and also, an image forming apparatus which is compatible with the process cartridge which is in accordance with the present invention.

According to an aspect of the present invention, there is provided a process cartridge detachably mountable to a main assembly of the apparatus of an image forming apparatus, said process cartridge comprising a first unit provided with an image bearing member; and a second unit which is provided with a developer carrying member for carrying a developer and which is connected with said first unit so as to be movable between a contact position in which said developer carrying member is contacted with said image bearing member and a spacing position in which said developer carrying member is spaced from said image bearing member, and said second unit including a first contact portion for contacting to a main assembly electrical contact provided in the main assembly of is the apparatus and for receiving a first contact force therefrom when said process cartridge is mounted to the main assembly of the apparatus and said second unit is positioned in the spacing position, and a second contact portion for contacting to the main assembly electrical contact and for receiving a second contact force therefrom to electrically connect with the main assembly electrical contact when said process cartridge is mounted to the main assembly of the apparatus and said second unit is positioned in the contact position, wherein the second contact force has a component oriented in a moving direction of moving said second unit away from the spacing position toward the contact position, and the component is greater than that of the first contact force.

According to another aspect of the present invention, there is provided a process cartridge detachably mountable to a main assembly of the apparatus of an image forming apparatus, said process cartridge comprising a first unit provided with an image bearing member; and a second unit which is provided with a developer carrying member for carrying a developer and which is connected with said first unit so as to be movable between a contact position in which said developer carrying member is contacted with said image bearing member and a spacing position in which said developer carrying member is spaced from said image bearing member, said second unit including a recess or opening into which a main assembly electrical contact provided in said main assembly of the apparatus to apply a voltage to said process cartridge when said process cartridge is mounted to said main assembly of the apparatus and second unit is positioned in the spacing position.

According to another aspect of the present invention, there is provided an image forming apparatus to which a process cartridge is detachably mountable, wherein said process cartridge includes a first unit provided with an image bearing member and a second unit which is provided with a developer carrying member for carrying a developer and which is connected with said first unit so as to be movable between a contact position in which said developer carrying member is contacted with said image bearing member and a spacing position in which said developer carrying member is spaced from said image bearing member, said apparatus comprising a main assembly electrical contact for contacting to and applying a first contact force to a first contact portion provided in said second unit when said second unit is in the spacing position, and for contacting to a second contact portion provided in said second unit to electrically connect with said second contact portion, wherein the second contact force has a component oriented in a direction of moving said second unit away from the spacing position toward the contact position, and the component is greater than that of the first contact force.

According to a further aspect of the present invention, there is provided an image forming apparatus to which a process cartridge is demountable, wherein said process cartridge includes a first unit provided with an image bearing member and a second unit which is provided with a developer carrying member for carrying a developer and which is connected with said first unit so as to be movable between a contact position in which said developer carrying member is contacted with said image bearing member and a spacing position in which said developer carrying member is spaced from said image bearing member, said apparatus comprising a main assembly electrical contact, capable of entering a recess or opening provided in said second unit, for applying a voltage to said process cartridge when said second unit is in the spacing position.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. However, the measurements, material, and shapes of the structural components of the image forming apparatus and process cartridge in the following preferred embodiments of the present invention, and their positional relationship, are to be modified as necessary according to the structure of the apparatus to which the present invention is applied, and also, according to various conditions under which the present invention is applied to the apparatus. That is, the following preferred embodiments of the present invention are not intended to limit the present invention in scope.

The present invention relates to the structure of the electrical contacts of an image forming apparatus, and the structure of the electrical contacts of a process cartridge for the image forming apparatus. In this specification, an "image forming apparatus" means an electrophotographic image forming apparatus which forms an image on recording medium with the use of an electrophotographic image forming method. Examples of an electrophotographic image forming apparatus include an electrophotographic copying machine, an electrophotographic printer (for example, laser beam printer, LED printer, and the like), a facsimile apparatus, a word processor, etc. A "process cartridge" means a cartridge which comprises a drum unit and a development unit, which are integrally connected to each other. The drum unit has an electrophotographic photosensitive drum, whereas the development unit has one or more developing means. The process cartridge is structured so that it can be removably mounted in the main assembly of the electrophotographic image forming apparatus. Incidentally, a process cartridge may be provided with a processing means for processing the electrophotographic photosensitive drum. Examples of the processing means include a charging means, a cleaning means, a developer supplying member for supplying the development roller with developer, a developer regulating member for regulating the layer of the developer on the peripheral surface of the development roller, in the amount (thickness), in addition to the development roller.

[Embodiment 1]

First, the first preferred embodiment of the present invention is described.

(General Structure of Image Forming Apparatus)

Figure 2:
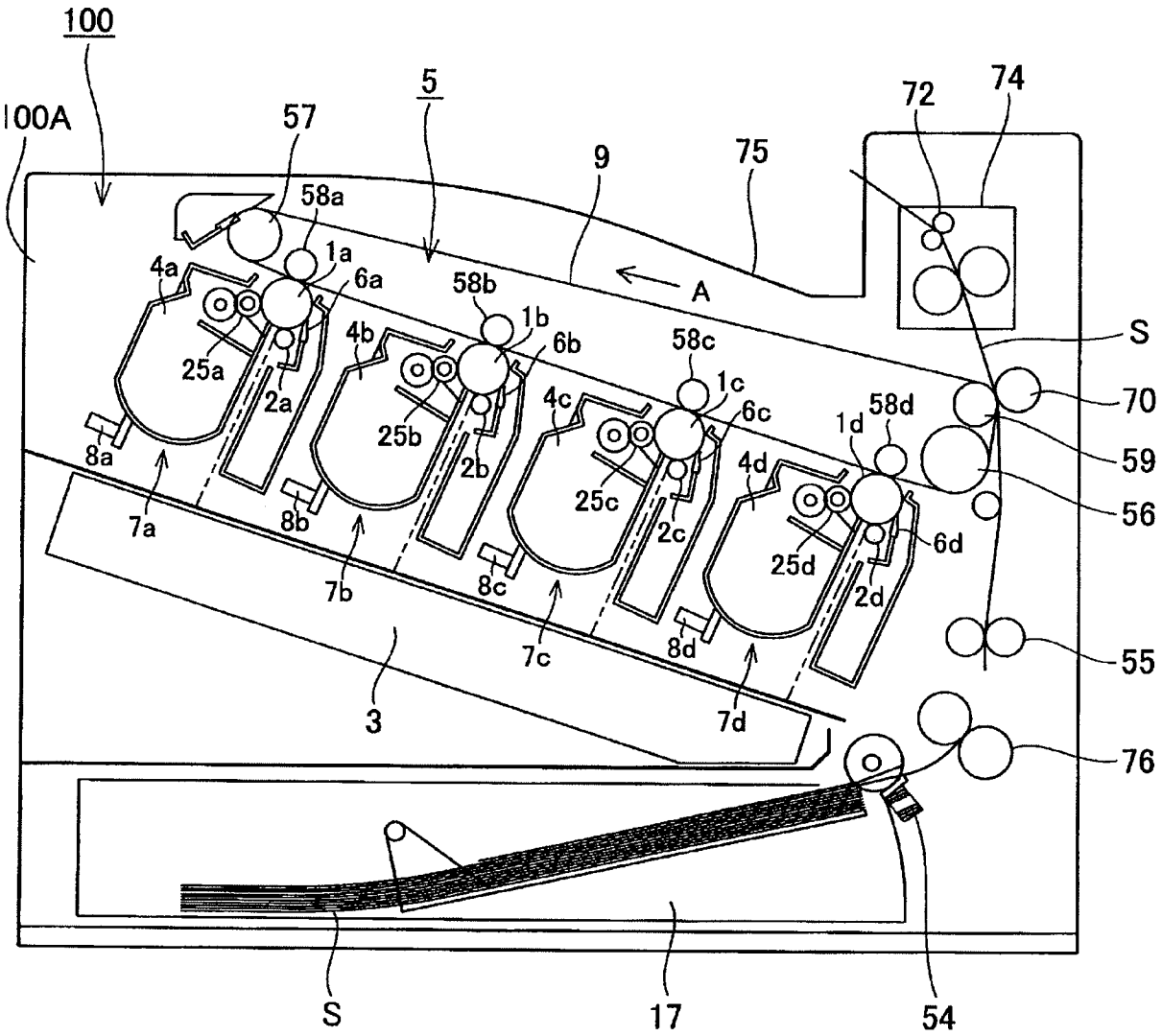
FIG. 2 is a schematic sectional view of the image forming apparatus in the first preferred embodiment of the present invention, and shows the general structure of the apparatus.

First, referring to FIG. 2, the overall structure of the electrophotographic image forming apparatus 100 (which hereafter will be referred to simply as image forming apparatus) in this embodiment.

FIG. 2 is a schematic sectional view of the image forming apparatus 100 in this embodiment, and shows the general structure of the apparatus. The image forming apparatus 100 employs four process cartridges 7 (7*a*, 7*b*, 7*c*, and 7*d*), which are removably mountable in the main assembly of the apparatus 100 with the use of a process cartridge mounting member (unshown), as shown in FIG. 2. Referring to FIG. 2, the process cartridges 7 (7*a*, 7*b*, 7*c*, and 7*d*) are positioned in the main assembly 100A of the image forming apparatus 100 (which hereafter will be referred to simply as apparatus main assembly 100A) in parallel at a preset angle relative to the horizontal direction of the apparatus main assembly 100A. The four process cartridges 7 are practically the same in structure and operation, except that they are different in the color of the developer (which hereafter will be referred to as toner) which they use. Therefore, in the following description of the preferred embodiments of the present invention, unless it is necessary to differentiate them, the suffixes a, b, c, and d, which indicate the color of the developers, one for one, will not be shown.

Each process cartridge 7 has an electrophotographic photosensitive drum 1 as an image bearing member (which hereafter will be referred to simply as photosensitive drum 1), and processing means, more specifically, a charge roller 2, a development roller 25, a cleaning means, etc., which are in the adjacencies of the peripheral surface of the photosensitive drum 1. The charge roller 2 is for uniformly charging the peripheral surface of the photosensitive drum 1. The development roller 25, which is a developer bearing member, is for bearing toner, and developing a latent image formed on the peripheral surface of the photosensitive drum 1 into a visible image with the use of the toner. The cleaning member 6 is for removing the toner remaining on the peripheral surface of the photosensitive drum 1 after the transfer of a toner image (developer image) formed on the peripheral surface of the photosensitive drum 1, onto recording medium. The apparatus main assembly 100A is provided with a scanner unit 3 for forming a latent image on the photosensitive drum 1 by selectively exposing numerous points of the peripheral surface of the photosensitive drum 1, based on the information of the image to be formed. The scanner unit 3 is below the space for the process cartridges 7 in the apparatus main assembly 100A.

The apparatus main assembly 100A is provided with a space for a cassette 17 which contains sheets S of recording medium. The space is in the bottom portion of the apparatus main assembly 100A. The apparatus main assembly 100A is also provided with a recording medium conveying means, which is positioned so that the sheet S of recording medium is conveyed upward from the cassette 17 by way of a second transfer roller 70 and a fixing portion 74. The recording conveying means comprises: a feed roller 54 which feeds each of the sheets S of recording medium in the cassette 17 into the apparatus main assembly 100A while separating it from the rest; a pair of recording medium conveying rollers 76 for conveying each sheet S of recording medium further into the apparatus main assembly 100A; a pair of registration rollers 76 for synchronizing the movement of a latent image formed on the peripheral surface of the photosensitive drum 1, with the movement of the sheet S of recording medium. Further, the apparatus main assembly 100A is provided with an intermediary transfer unit 5 as an intermediary means for transferring a toner image formed on the peripheral surface of the photosensitive drum 1, from the photosensitive drum 1 onto the sheet. S of recording medium. The intermediary transfer unit 5 is above the space for the process cartridge 7. The intermediary transfer unit 5 has a driver roller 56, a follower roller 57, four first transfer rollers 58, a second transfer roller 70, a backup roller 59, and a transfer belt 9. The four first transfer rollers 58 correspond in position to the four photosensitive drums 1, one for one. The backup roller 59 corresponds in position to the second transfer roller 70. The transfer belt 9 wraps around these rollers, being thereby suspended and kept stretched, by them.

The transfer belt 9 is circularly moved in such a manner that it faces all the photosensitive drums 1 and comes into contact with them. As voltage is applied to the first transfer roller 58, the toner on the photosensitive drum 1 is transferred (first transfer) onto the transfer belt 9. Then, as voltage is applied between the backup roller 59 (which is on inward side of loop which transfer belt 9 forms) and the second transfer roller 70, the toner on the transfer belt 9 is transferred (second transfer) onto the sheet S of recording medium.

The image forming operation of the image forming apparatus 100 is as follows: While each photosensitive drum 1 is rotated, the peripheral surface of the photosensitive drum 1 is uniformly charged by the charge roller 2. Then, the numerous points of the uniformly charged portion of the peripheral surface of the photosensitive drum 1 are selectively exposed by the scanner unit 3. Consequently, an electrostatic latent image is formed on the photosensitive drum 1. This latent image is developed by the development roller 25. Thus, four monochromatic toner images, different in color, are formed on the four photosensitive drums 1, one for one. In synchronism with the formation of the toner images, a sheet S of recording medium is conveyed by the pair of registration rollers 55, to the second transfer position, in which the backup roller 59 and second transfer roller 70 are kept in contact with each other, with the presence of the transfer belt 9 between the two rollers 59 and 70. Then, transfer bias voltage is applied to the second transfer roller 7 while the sheet S of recording medium is conveyed through the second transfer position. Thus, the four monochromatic toner images, different in color, on the transfer belt 9 are transferred (second transfer) onto the sheet S of recording medium. This is how a multicolor image is formed on the sheet S of recording medium. After the formation of a multicolor image on the sheet S of recording medium, the sheet S is conveyed through the fixing portion 74. While the sheet S is conveyed through the fixing portion 74, the multicolor image is subjected to heat and pressure, whereby it becomes fixed to the sheet S. Thereafter, the sheet S is discharged into a delivery tray 75 by a pair of discharge roller 72. Incidentally, the fixing portion 74 is in the top portion of the apparatus main assembly 100A.

(Process Cartridge)

Figure 3:
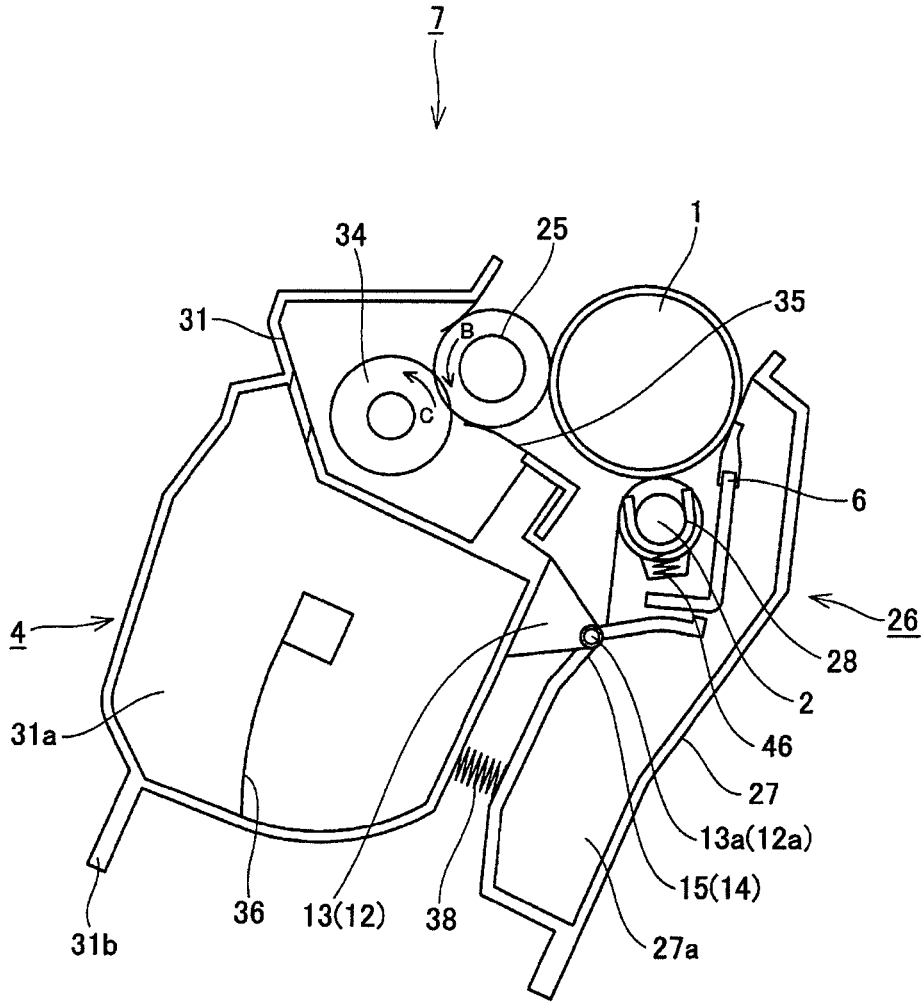
FIG. 3 is a schematic sectional view of the process cartridge (which contains toner) in the first preferred embodiment of the present invention, and shows the general structure of the cartridge.
Figure 4:
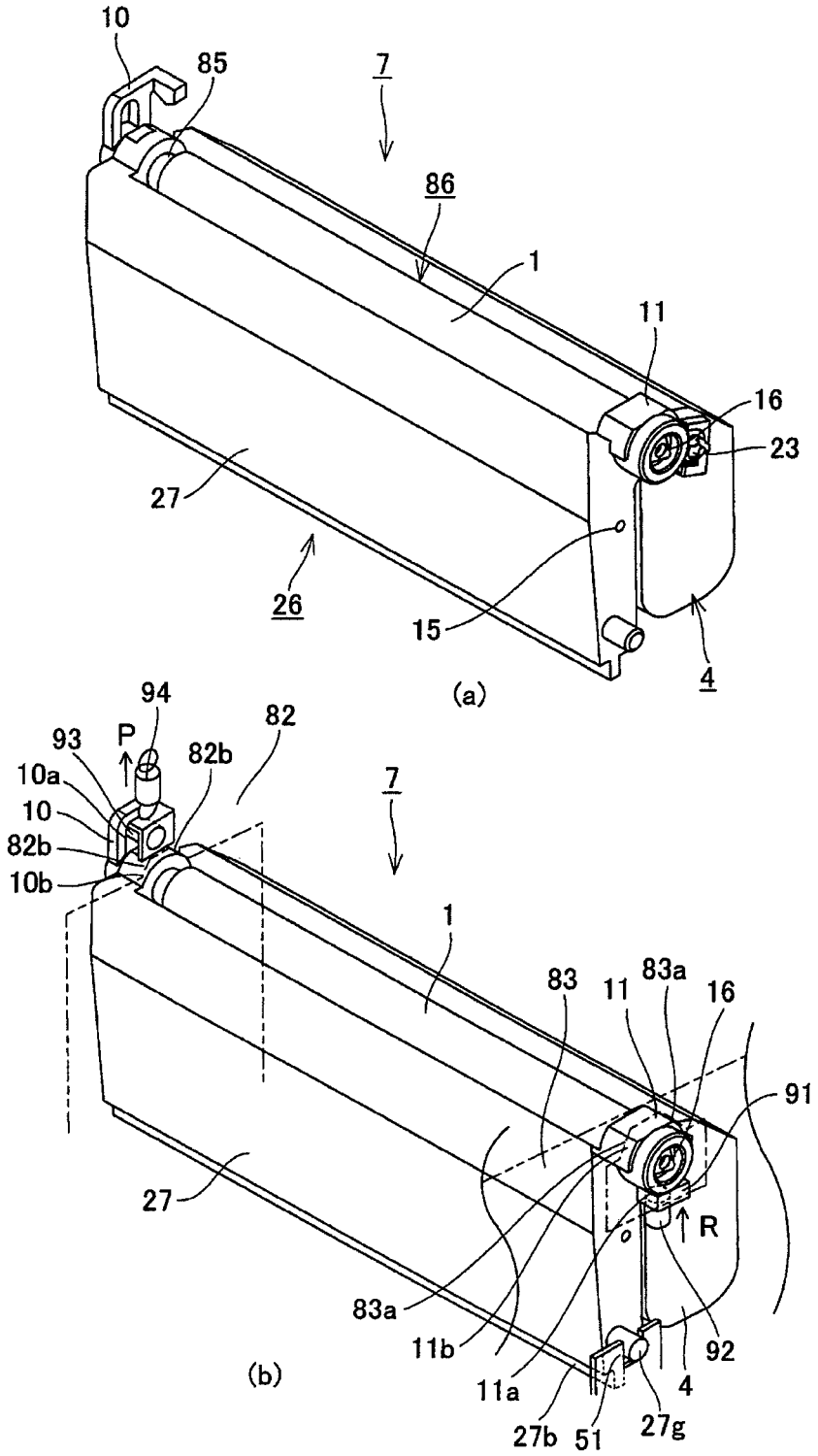
FIG. 4 is a schematic perspective view of the process cartridge in the first preferred embodiment of the present invention.
Figure 5:
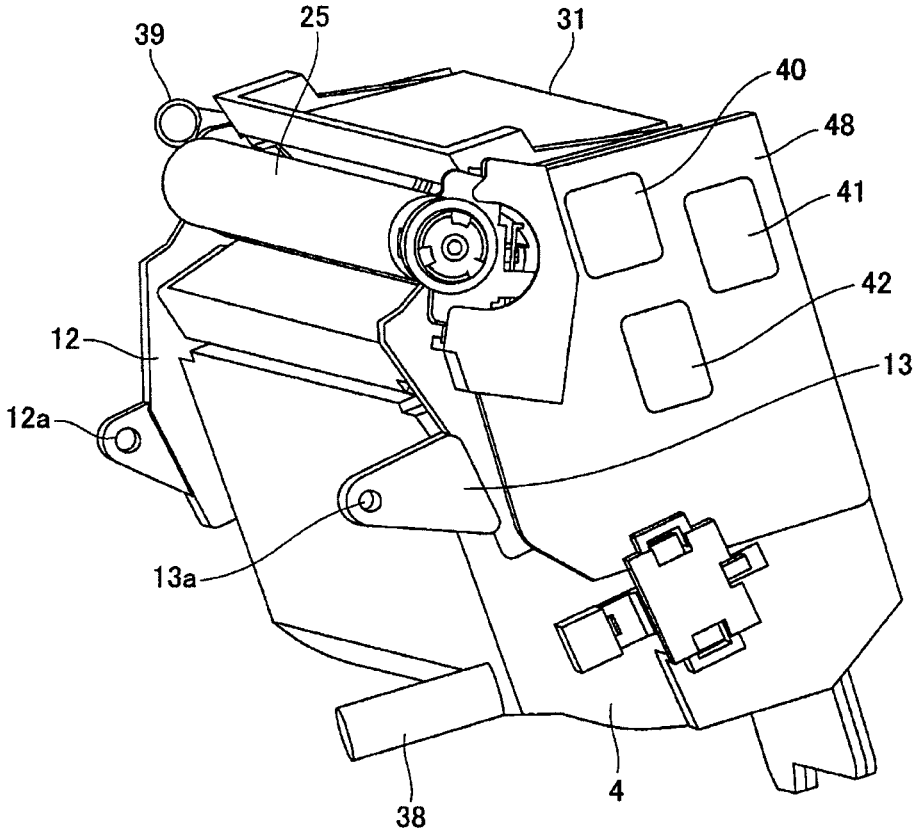
FIG. 5 is a schematic perspective view of the development unit in the first preferred embodiment of the present invention.

Next, referring to FIGS. 3-5, the process cartridge 7 in this embodiment is described. FIG. 3 is a schematic sectional view of the process cartridge 7, which stores toner. Incidentally, the process cartridges 7*a*, 7*b*, 7*c*, and 7*d*, which store yellow, magenta, cyan, and black toners, respectively, are the same in structure. FIG. 4(*a*) is a schematic perspective view of the process cartridge 7 in this embodiment, prior to the mounting of the process cartridge 7 into the apparatus main assembly 100A, and shows the general structure of the process cartridge 7. FIG. 4(*b*) is a schematic perspective view of the process cartridge 7 in this embodiment after the proper positioning of the process cartridge 7 in the apparatus main assembly 100A. FIG. 5 is a schematic perspective view of the development unit in this embodiment. The process cartridge 7 has: a drum unit 26 as the first unit; and a development unit 4 as the second unit. The drum unit 26 has the photosensitive drum 1, charge roller 2, and cleaning member 6. The development unit 4 has the development roller 25.

The drum unit 26 has a cleaning means frame 27, to which the photosensitive drum 1 is rotatably attached with the presence of a front drum bearing 10 and a rear drum bearing 11 between the photosensitive drum 1 and cleaning means frame 27. One of the lengthwise end portions of the photosensitive drum 1 is provided with a drum coupling 16, and the other is provided with a flange 85 (FIG. 4). The charge roller 2 and cleaning member 6 are in the adjacencies of the peripheral surface of the photosensitive drum 1, as described above, and are in contact with the peripheral surface of the photosensitive drum 1. As the residual toner on the peripheral surface of the photosensitive drum 1 is removed by the cleaning member 6, it falls into the waste toner chamber 27*a*. As the driving force from a motor (unshown) of the apparatus main assembly 100A, which is the source of the drum driving force, is transmitted to the drum unit 26, the photosensitive drum 1 is rotated in synchronism with the progression of the on-going image forming operation. The charge roller 2 is rotatably attached to the cleaning means frame 27 with the presence of a pair of charge roller bearings 28 between the charge roller 2 and frame 27. The charge roller 2 is kept pressed upon the photosensitive drum 1 by a charging roller pressing member 46, and is rotated by the rotation of the photosensitive drum 1.

The development unit 4 comprises: the development roller 25 which rotates in contact with the photosensitive drum 1 in the direction indicated by an arrow mark B in FIG. 3; and a development unit frame 31 which supports the development roller 25. The development roller 25 is rotatably supported by the development unit frame 31. More specifically, the front and rear walls of the development unit frame 31 are provided with front and rear development roller bearings 12 and 13, respectively, by which the development roller 25 is supported (FIG. 5). Further, the development unit 4 is provided with a toner supply roller 34 and a development blade 35, which are in the adjacencies of the peripheral surface of the development roller 25. The toner supply roller 34 is in contact with the peripheral surface of the development roller 25 and rotates in the direction indicated by an arrow mark C in FIG. 3. The toner supply roller 34 is a member for supplying the peripheral surface of the development roller 25 with developer (toner). The development blade 35 is for regulating the layer of toner on the peripheral surface of the development roller 25. It is a member for regulating the amount by which developer (toner) is borne on the peripheral surface of the development roller 25 per unit area of the peripheral surface of the development roller 25. Further, the development unit 4 is provided with a toner conveying member 36 which is in the toner storage chamber 31*a* of the development unit frame 31. The toner conveying member is for conveying toner in the toner storage chamber 31*a*, to the toner supply roller 34 while stirring the toner.

Referring to FIG. 3, the development unit 4 is attached to the drum unit 26 in such a manner that the development unit 4 is rotationally movable relative to the drum unit 26. More specifically, development unit supporting front and rear pins 14 and 15 are pressed into the holes of the cleaning means frame 27, and then, are fitted in the holes 12*a* and 13*a* of the aforementioned front and rear development roller bearings 12 and 13, respectively, of the development unit 4. Thus, the development unit 4 is rotationally movable relative to the cleaning means frame 27 about the development unit supporting pins 14 and 15 (FIG. 3). Further, the cleaning means frame 27 is provided with front and rear drum bearings 10 and 11, respectively, which rotatably support the photosensitive drum 1. The rear drum bearing 11 supports the drum coupling 16 which is in connection to the photosensitive drum 1, whereas the front drum bearing 10 supports the flange 85. The drum coupling 16 is for transmitting rotational driving force (first rotational driving force) from the apparatus main assembly 100A to the photosensitive drum 1 (FIG. 4).

The process cartridge 7 is structured so that when the process cartridge 7 is being used for image formation, the development unit 4, which is shown in FIG. 5, is kept pressed toward the drum unit 26 by a compression spring 38, with which the development unit frame 31 is provided, and a tension spring 39 with which the front development roller bearing 12 is provided. The compression spring 38 is for providing the pressure for keeping the development roller 25 in contact with the photosensitive drum 1. The compression spring 38 is between the cleaning means frame 27 and development unit frame 31, and remains compressed. One end of the tension spring 39 is attached to front development roller bearing 12, whereas the other end is attached to the front drum bearing 10. The forces generated by the compression spring 38 and tension spring 39 keep the development roller 25 in contact with the photosensitive drum 1.

The front end of the development unit 4 is provided with an electrical contact 40 for the development roller 25 (which hereafter is referred to as development roller contact 40), an electrical contact 41 for the toner supply roller 34 (which hereafter is referred to as toner supply roller contact 41), and an electrical contact 42 for the development blade 35 (which hereafter is referred to as development blade contact 42). The development roller contact 40 is for applying bias voltage to the development roller 25. The toner supply roller contact 41 is for applying bias voltage to the toner supply roller 34. The development blade contact 42 is for applying bias voltage to the development blade 35. In a case where the image forming apparatus 100 is of the contact development type which places the development roller 25 in contact with the photosensitive drum 1 to develop a latent image on the photosensitive drum 1, it is desired that the photosensitive drum 1 is a rigid member, whereas the development roller 25 is an elastic roller, that is, a roller having an elastic layer. As the development roller 25, a roller having a single layer of solid rubber, a roller having a solid rubber layer and a resin layer coated on the solid rubber layer in consideration of the charging of toner by the roller, or the like roller, is usable.

Next, the image formation sequence of the process cartridge 7 is described (FIGS. 2 and 3). As the information of the image to be formed is sent to the image forming apparatus 100, the motor (unshown) of the apparatus main assembly 100A begins to rotate, whereby rotational driving force is transmitted to the development roller 25, toner supply roller 34, and toner conveying member 36. Then, the charge bias is applied to the charge roller 2 from the apparatus main assembly 100A, whereby the peripheral surface of the photosensitive drum 1 is uniformly charged. Then, the uniformly charged portion of the peripheral surface of the photosensitive drum 1 is exposed to the beam of light projected from the scanner unit 3 while being modulated with the information of the image to be formed. Consequently, a latent image is formed on the photosensitive drum 1.

The toner in the toner storage portion 31*a* is conveyed to the toner supply roller 34 by the rotation of the toner conveying member 36. To the toner supply roller 34, the bias voltage is applied. As the toner supply roller 34 is rotated, the peripheral surface of the rotating development roller 25 is supplied with the toner from the toner supply roller 34. After being supplied to the peripheral surface of the development roller 25, the toner on the peripheral surface of the development roller 25 is frictionally charged by the development blade 35 to which the bias voltage is being applied. Further, to the development roller 25, the development bias is applied from the apparatus main assembly 100A, whereby the electrostatic latent image formed on the photosensitive drum 1 is developed.

The development roller 25 is positioned so that its peripheral surface squarely faces the peripheral surface of the photosensitive drum 1. Further, the development unit 4 is structured so that the development roller 25 develops the electrostatic latent image formed on the peripheral surface of the photosensitive drum 1, by being placed in contact with the peripheral surface of the photosensitive drum 1.

(Mechanism for Mounting Process Cartridge into Main Assembly of Image Forming Apparatus)

Figure 6:
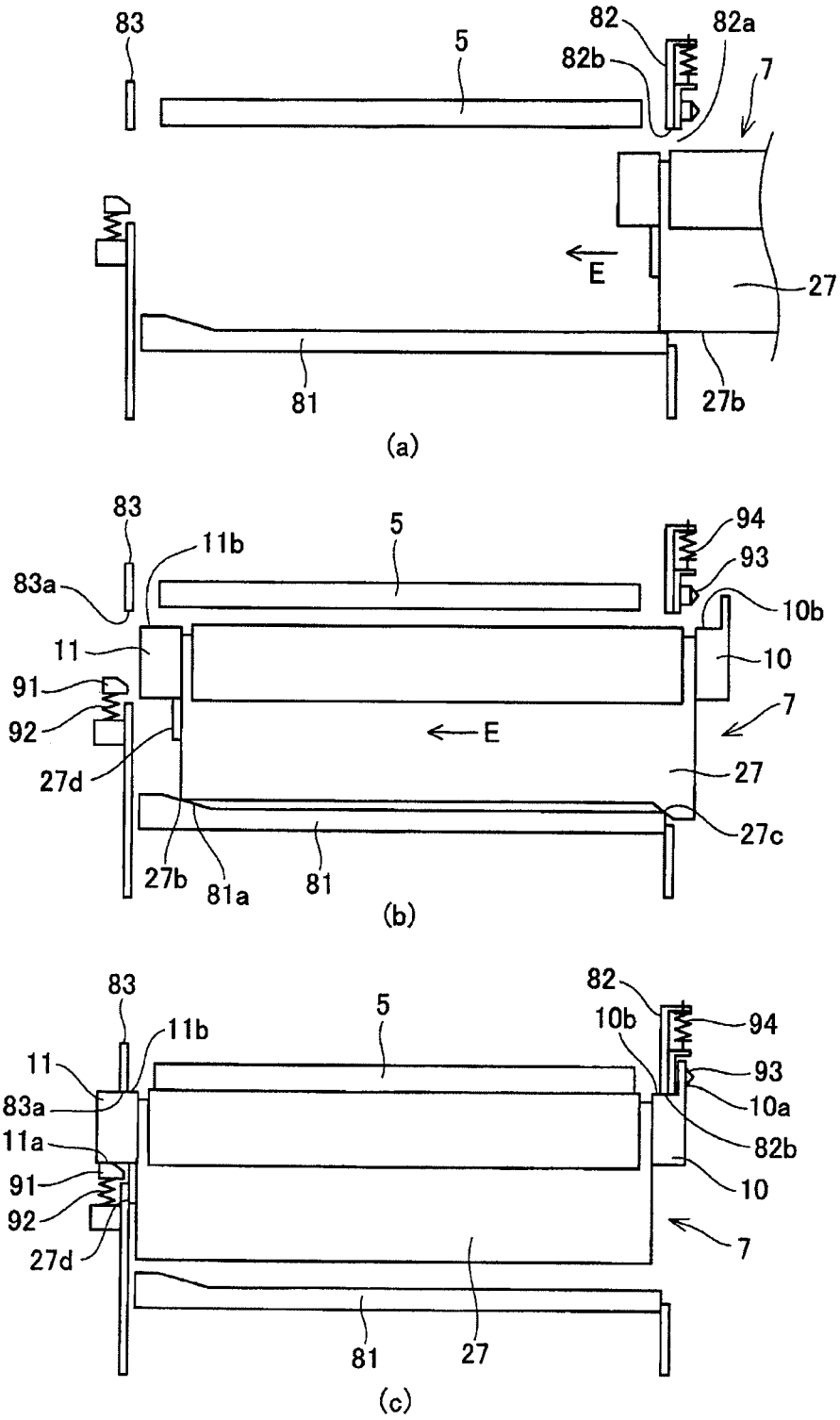
FIG. 6 is a drawing for describing the operation for mounting the process cartridge into the main assembly of the image forming apparatus.

Next, referring to FIG. 6, the mechanism for to mounting the process cartridge 7 into the apparatus main assembly 100A is described. FIG. 6 is a schematic drawing for describing the operation for mounting the process cartridge 7 into the apparatus main assembly 100A. FIG. 6(*a*) is a drawing for describing the process cartridge 7 which is in the state prior to its mounting into the apparatus main assembly 100A. Referring to FIG. 6(*a*), the process cartridge 7 is inserted into the apparatus main assembly 100A in the direction indicated by an arrow mark E through the opening 82*a* with which the front plate 82 of the apparatus main assembly 100A is provided. During the insertion of the process cartridge 7, the process cartridge 7 is guided by the process cartridge guiding member 81 of the apparatus main assembly 100A; a cartridge guiding portion 27*b*, which is an integral part of the cleaning means frame 27 of the process cartridge 7, is guided by the cartridge guiding member 81 by being rested on the guiding member 81. The process cartridge guiding member 81, that is, the process cartridge guiding member on the main assembly side, is the member for removably mounting the process cartridge 7 into the apparatus main assembly 100A.

FIG. 6(*b*) is a drawing for describing the process cartridge 7 which is being mounted into the apparatus main assembly 100A. The cartridge guiding member 81 of the apparatus main assembly 100A is provided with a slanted surface 81*a*, which is at the downstream end of the guiding member 81 in terms of the direction in which the process cartridge 7 is inserted into the apparatus main assembly 100A. The slanted surface 81*a* inclines upward in terms of the cartridge insertion direction. Further, the cleaning means frame 27 is provided with a slanted surface 27*c*, which is at the upstream end of the cleaning means frame 27. The slanted surface 27*c* inclines downward in terms of the opposite direction to the cartridge insertion direction. As the process cartridge 7 is inserted into the apparatus main assembly 100A, the guiding portion 27*b* of the cleaning means frame 27 comes into contact with the slanted surface 81*a*, and slides diagonally upward by being guided by the slanted surface 81*a*, whereas the slanted surface 27*c* comes into contact with the cartridge guiding member 81, whereby the trailing end portion of the process cartridge 7 slides diagonally upward by being guided by the slanted surface 27*c*. Thus, the process cartridge 7 is moved toward the intermediary transfer unit 5 (upward).

FIG. 6(*c*) is a drawing for describing the process cartridge 7 after it is properly positioned in the apparatus main assembly 100A. As the process cartridge 7 is inserted further into the apparatus main assembly 100A after it is moved toward the intermediary transfer unit 5, a stopper 27*d*, which is an integral part of the cleaning means frame 27 comes into contact with the rear plate 83 of the apparatus main assembly 100A, which completes the mounting of the process cartridge 7 into the apparatus main assembly 100A. When the process cartridge 7 is in the state shown in FIG. 6(*c*), the bearing positioning portion 11*a* of the rear drum bearing 11 is in contact with the bearing pressing (positioning) member 91 of the rear plate 83, which is under the upward pressure generated by a compression spring 92. Therefore, the rear drum bearing 11 is kept pressed upward. Further, the cartridge positioning portion 11*b*, which is a part of the top portion of the rear drum bearing 11, is in contact with the cartridge positioning portion 83*a* of the rear plate 83. Therefore, the rear end of the process cartridge 7 is properly positioned relative to the apparatus main assembly 100A.

Also right before the cartridge stopper portion 27*d* comes into contact with the rear plate 83 of the apparatus main assembly 100A, the bearing pulling member 93 of the front plate 82 fits into the hole of the bearing pulling portion of the front drum bearing 10. Thus, the bearing pulling portion 10*a* of the front drum bearing 10 is moved upward by the bearing pulling portion 93 which is under the upward pressure generated by the tension spring 94 of the front plate 82. Therefore, the stopper portion 10*b* of the front drum bearing 10, which is the cartridge positioning portion of the front drum bearing 10, is placed in contact with the bearing positioning portion 82*b* of the front plate 82, whereby the front end of the process cartridge 7 is precisely positioned relative to the apparatus main assembly 100A.

Next, referring to FIG. 4(*b*), the cartridge positioning portion 83*a* (contoured by two-dot chain line in FIG. 4(*b*)) has a roughly V-shaped groove, into which the bearing positioning portion 11*b* of the rear drum bearing 11 fits. The cartridge 7 is structured so that as the bearing pulling member 93 of the front plate 82 fits into the hole of bearing pulling portion 10*a* of the front drum bearing 10, the front drum bearing 10 is pulled in the direction indicated by an arrow mark P. Further, regarding the positioning of the front drum bearing 10, the front drum bearing 10 fits into the V-shaped groove of the drum positioning portion 82*b* (contoured by double-dot chain line in FIG. 4(*b*)) of the front plate 82. Further, the pressure necessary for precisely positioning the front and rear drum bearings 10 and 11 are applied in the direction indicated by the arrow marks P and R from the apparatus main assembly 100A. Therefore, the front and rear drum bearings 10 and 11 to which rotatably support the photosensitive drum 1, and by which the process cartridge 7 is precisely positioned relative to the apparatus main assembly 100A, are accurately positioned relative to the apparatus main assembly 100A. Further, one of the lateral plates of the cleaning means frame 27 is provided with a boss 27*g* which functions as a stopper for preventing the process cartridge 7 from rotating. The boss 27*g* fits into the groove of the process cartridge rotation controlling member 51 of the apparatus main assembly 100A, whereby the process cartridge 7 is prevented from rotating in the apparatus main assembly 100A.

(Mechanism for Separating Photosensitive Drum and Development Roller of Process Cartridge from Each Other, or Placing Them in Contact with Each Other)

Figure 7:
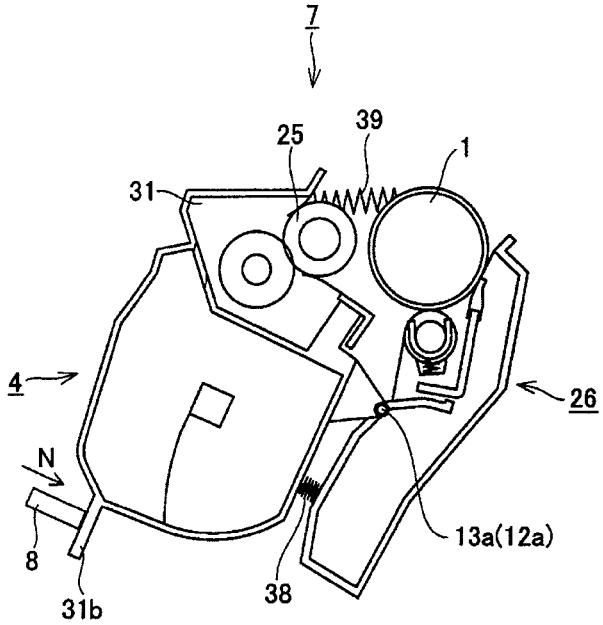
FIG. 7 is a drawing for describing the operation for separating the photosensitive drum and development roller from each other, or placing them in contact with each other, in the first preferred embodiment of the present invention.
Figure 7:
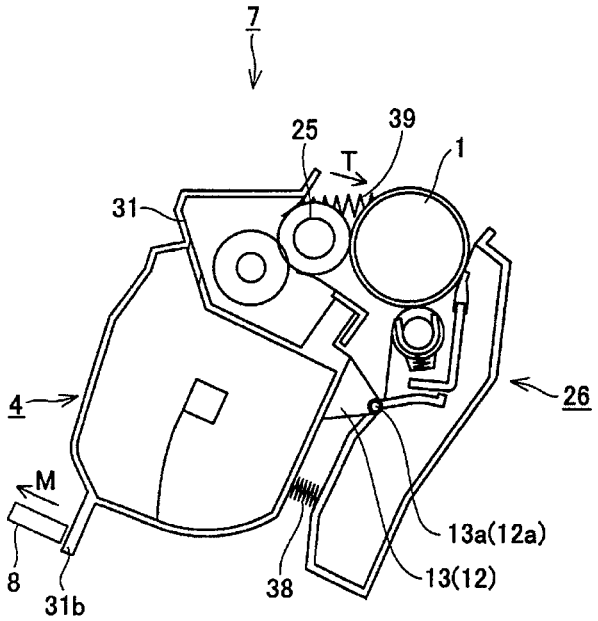

Next, referring to FIG. 7, the mechanism for separating the photosensitive drum 1. (drum unit 26) and development roller 25 (development unit 4) of the process cartridge 7 from each other, or placing them in contact with each other, is described. Hereafter, this mechanism may be referred to simply as "separation-contact mechanism", FIG. 7(*a*) is a schematic sectional view of the process cartridge 7 in this embodiment, which is for describing how the photosensitive drum 1 and development roller 25 are separated from each other, and kept separated from each other. FIG. 7(*b*) is a schematic sectional view of the process cartridge 7 in this embodiment, which is for describing how the photosensitive drum 1 and development roller 25 are placed in contact with each other, and kept in contact with each other. Referring to FIG. 7(*a*), the image forming apparatus 100 has a member 8 for keeping the development roller 25 separated from the photosensitive drum 1. Hereafter, the member 8 is referred to as the separation member As soon as an image forming operation is ended, the separation member 8 is moved in the direction indicated by an arrow mark N, and the separation force catching portion 31*b* of the development unit 4 of the process cartridge 7 is pressed by the separation member 8. Thus, the development unit 4 is rotationally moved into the position in which it keeps the development roller 25 separated from the photosensitive drum 1. Hereafter, this position of the development unit 4 is referred to as the "separation position".

Next, referring to FIG. 7(*b*), as the separation member 8 separates from the separating force catching portion 31*b* by being moved in the direction indicated by an arrow mark M, the development unit 4 is rotationally moved in the direction indicated by an arrow mark T, about the axial lines of the holes 12*a* and 13*a* of the front and rear development unit bearings 12 and 13, respectively, by the resiliency of the compression spring 38, and the resiliency of the tension spring 39. As the development unit 4 is moved as described above, the development roller 25 comes into contact with the photosensitive drum 1. Hereafter, the position in which the development unit 4 is when the development roller 25 is kept in contact with the photosensitive drum 1 is referred to as the "contact position". Since the image forming apparatus 100 and process cartridge 7 are structured so that the development roller 25 is separated from, or placed in contact with, the photosensitive drum 1 as described above, the development unit 4 can be kept in the separation position (shown in FIG. 7(*a*)) except for during image formation. Therefore, the development roller 25 is unlikely to be deformed by the contact between the development roller 25 and photosensitive drum 1. Therefore, the image forming apparatus 100 in this embodiment is unlikely to output low quality images, the low quality of which is attributable to the deformation of the development roller 25.

(Member for Separating, and Keeping Separated, Development Roller from Photosensitive Drum)

Figure 8:
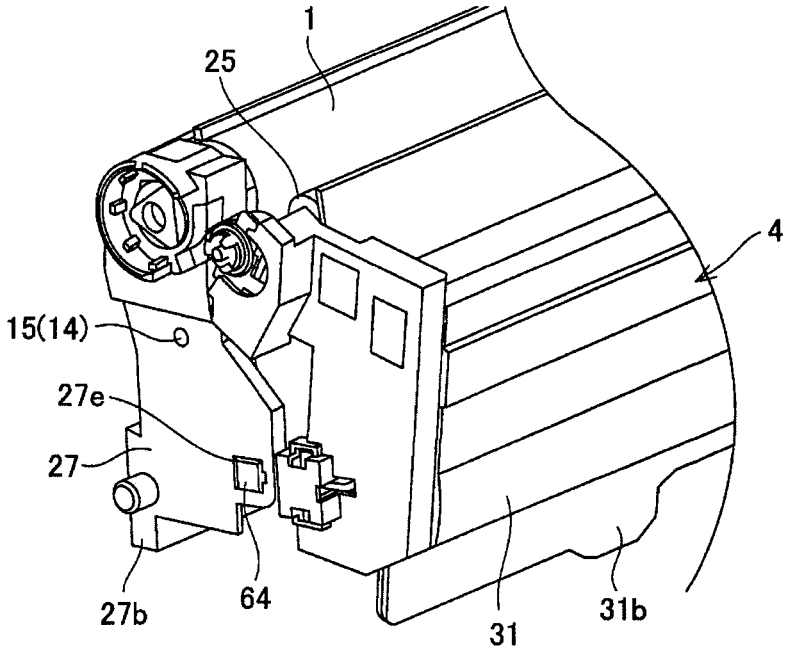
FIG. 8 is a schematic perspective view of the process cartridge in the first preferred embodiment of the present invention.
Figure 8:
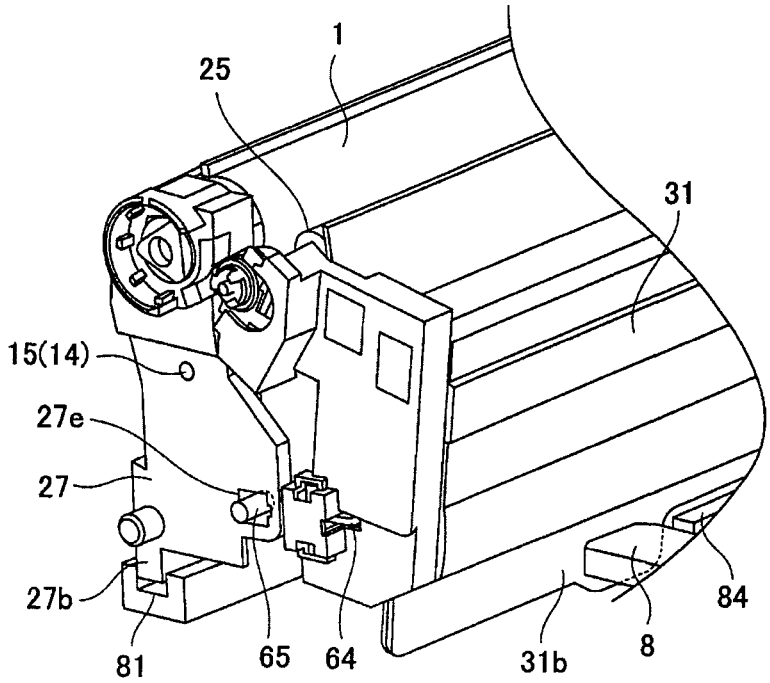

FIG. 8(*a*) is a schematic perspective view of the process cartridge 7 prior to the mounting (insertion) of the process cartridge 7 into the apparatus main assembly 100A. The process cartridge 7 is provided with a member 64 for keeping the development unit 4 locked in the separation position. Hereafter, the member 64 is referred to as a cartridge locking member 64. When the process cartridge 7 is in the state shown in FIG. 8(*a*), the cartridge locking member 64 is in the hole 27*e* of the lateral plate of the cleaning means frame 27, and keeps the development roller 25 separated from the photosensitive drum 1. The position of the cartridge locking member 64, which is shown in FIG. 8(*a*), is referred to as the "engagement position".

FIG. 8(*b*) is a schematic perspective view of the process cartridge 7 after the disengagement of the cartridge locking member 64 has allowed the development roller 25 to come into contact with the photosensitive drum 1. Referring to FIG. 8(*b*), the apparatus main assembly 100A is provided with a member 65 which is for disengaging the cartridge locking member 64, and comes into contact with the cartridge locking member 64 when the process cartridge 7 is mounted into the apparatus main assembly 100A. More specifically, the apparatus main assembly 100A and process cartridge 7 are structured so that as the process cartridge 7 is inserted into the apparatus main assembly 100A, the member 65 for disengaging the cartridge locking member 64 disengaging the cartridge locking member 64 from the hole 27*e* by coming into contact, and pressing on, the cartridge locking member 64 right before the process cartridge 7 is precisely positioned relative to the apparatus main assembly 100A by the cartridge positioning portions 82*b* and 83*a* (FIG. 6) of the apparatus main assembly 100A. The position of the cartridge locking member 64 after its disengagement from the hole 27*e*, which is shown in FIG. 8(*b*), is referred to as the disengagement position of the cartridge locking member 64. As the cartridge locking member 64 is moved out of the hole 27*e*, it becomes possible for the development roller 25 to come into contact with the photosensitive drum 1. However, the apparatus main assembly 100A is structured so that when the process cartridge 7 is in its image forming position in the apparatus main assembly 100A, the separation member 8 of the apparatus main assembly 100A is in the position in which it presses on the separation force catching portion 31*b* of the development unit frame 31 (FIG. 7(*a*)). Therefore, even if the cartridge locking member 64 is moved out of the hole 27*e* by the mounting of the process cartridge 7 into the apparatus main assembly 100A, the development roller 25 does not immediately come into contact with the photosensitive drum 1 (FIG. 7(*a*)).

Figure 9:
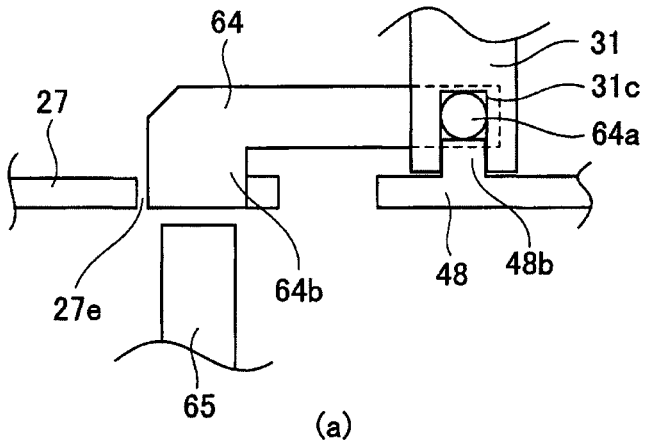
FIG. 9 is a drawing for describing the movement of the member of the process cartridge in the first preferred embodiment, which is for keeping the development roller separated from the photosensitive drum.
Figure 9:
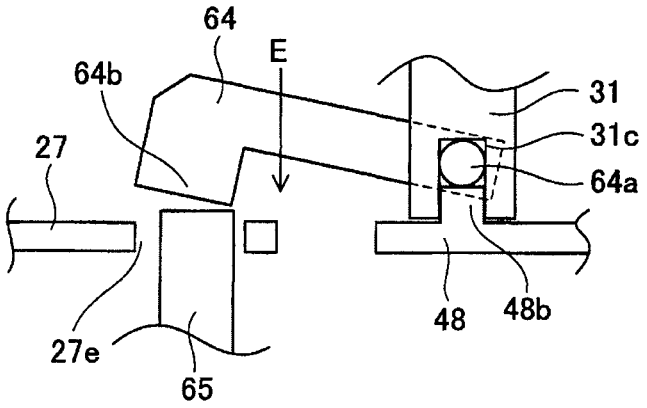
Figure 9:
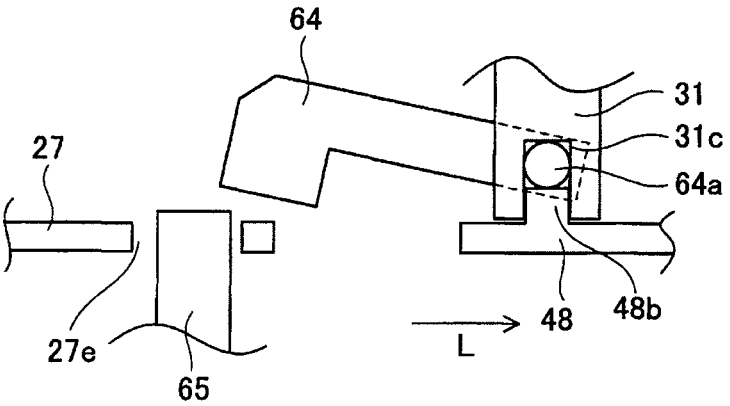

Next, referring to FIG. 9, the method for disengaging the cartridge locking member 64 of the process cartridge 7 is described. FIG. 9(*a*) is a schematic drawing of the cartridge locking member 64, cartridge locking member disengaging member 65, and cleaning means frame 27, when the cartridge locking member 64 is in engagement with the cleaning means frame 27. FIG. 9(*b*) is a schematic drawing of the cartridge locking member 64, cartridge locking member disengaging member 65, and cleaning means frame 27 when the cartridge locking member disengaging member 65 is pressing on the cartridge locking member 64. FIG. 9(*c*) is a schematic drawing of the cartridge locking member 64, cartridge locking member disengaging member 65, and cleaning frame 27 when the cartridge locking member 64 has been disengaged from the cleaning means frame 27 by the cartridge locking member disengaging member 65. FIG. 9(*a*) shows a boss 64*a* with which the cartridge locking member 64 is provided. The boss 64*a* is in the groove 31*c* of the development unit frame 31, and is rotatably supported by the development unit frame 31. It remains in the groove 31*c* by being kept pressed by the boss pressing portion 48*b* of the side cover 48. The engaging portion 64*b* of the cartridge locking member 64 is in the hole 27*e* of the cleaning means frame 27.

Next, referring to FIG. 9(*b*), as the process cartridge 7 is moved in the direction indicated by the arrow mark E when the cartridge locking member 64 is in the state shown in FIG. 9(*a*), the cartridge locking member disengaging member 65 comes into contact with the cartridge locking member 64. Then, the cartridge locking member disengaging member 65 is moved into the hole 27*e* while pressing on the cartridge locking member 64. Thus, the cartridge locking member 64 is rotated about the boss 64*a* by the cartridge locking member disengaging member 65, being thereby disengaged from the cleaning member 27.

Consequently, it becomes possible for the development unit frame 31 to be moved in the direction indicated by an arrow mark L, that is, the direction for placing the development roller 25 in contact with the photosensitive drum 1.

As an image forming operation is started by a print signal after the completion of the mounting of the process cartridge 7, the separation member 8 (FIG. 7(*b*)) is moved in the direction indicated by the arrow mark M in synchronism with the timing with which the development operation is started. Thus, the separation member 8 moves away from the separation force catching portion 31*b*. Therefore, the development unit 4 is moved into the contact position by the resiliency of the compression spring 38 and the resiliency of the tension spring 39 (FIG. 7(*b*)), whereby the development roller 25 is placed in contact with the photosensitive drum 1, being enabled to develop the latent image on the photosensitive drum 1.

As soon as the development of the latent image on the photosensitive drum 1 ends, the separation member 8 is moved in the direction indicated by the arrow mark N in FIG. 7(*a*), pressing thereby on the separation force catching portion 31*b*. Consequently, the development unit 4 is moved back into the separation position where the development roller 25 is kept separated from the photosensitive drum 1. Unless the development unit 4 is being used for image formation, it is kept in the separation position, that is, the position in which the development roller 25 is kept separated from the photosensitive drum 1.

As described above, in this embodiment, the development unit 4 can be easily placed in the state in which the development roller 25 is kept separated from the photosensitive drum 1, or the state in which the development roller 25 is kept in contact with the photosensitive drum 1. Therefore, it is unnecessary to strictly select the material for the elastic layer of the development roller 25 in order to prevent the deformation of the elastic layer.

(Structure of Electrical Contacts of Process Cartridge and Apparatus Main Assembly)

Figure 10:
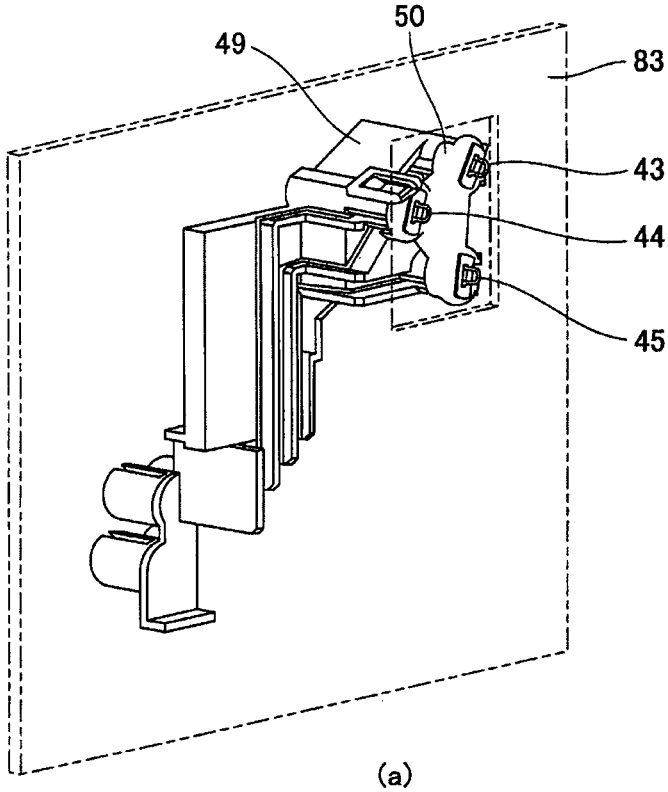
FIG. 10 is a drawing for describing the electrical contacts of the main assembly of the image forming apparatus in the first preferred embodiment of the present invention.
Figure 10:
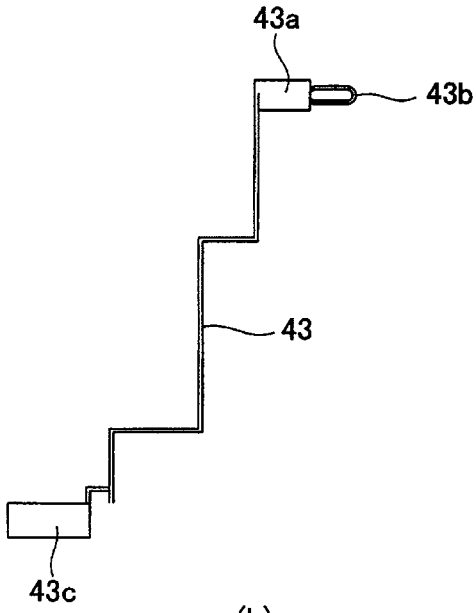

Next, the structure of the electrical contacts of the process cartridge 7 and apparatus main assembly 100A is described. FIG. 10(*a*) is a schematic perspective view of the electrical contacts, and their adjacencies, of the apparatus main assembly 100A in this embodiment. FIG. 10(*b*) is a schematic drawing of the electric contacts of the apparatus main assembly 100A in this embodiment. The primary characteristic feature of this embodiment is that the contact pressure between the electrical contacts of the apparatus main assembly 100A and the electrical contacts of the process cartridge 7 is utilized as an additional force for keeping the development roller 25 pressed on the photosensitive drum 1. Next, this feature is described in detail.

The process cartridge 7 has the above described electrical contact 40 for the development roller 25, electrical contact 41 for the toner supply roller 34, and electrical contact 42 for the development blade 35 (FIG. 5). These electrical contacts are at one of the lengthwise ends of the process cartridge 7 in terms of the lengthwise direction of the development roller 25. Referring to FIG. 10(*a*), the electrical contacts of the apparatus main assembly 100A are on the inward surface of the rear plate 83, which is on the downstream side of the apparatus main assembly 100A in terms of the direction in which the process cartridge 7 is inserted into the apparatus main assembly 100A. The development bias contact 43, toner supply roller bias contact 44, and development blade bias contact 45, which are the electrical contacts of the apparatus main assembly 100A, are supported by the electrical contact holder 49, which has a cover 50. The electrical contacts of the apparatus main assembly 100A are in connection to the high voltage circuit (unshown) in the apparatus main assembly 100A, so that they can be supplied with bias voltage from the high voltage circuit.

Next, the structure of the development roller contact 40 of the process cartridge 7 and the development bias contact 43 of the apparatus main assembly 100A are described as the examples of the structure of the electrical contacts in this embodiment. That is, in this embodiment, the structure of the toner supply roller contact 41, the structure of the toner supply bias contact 44, and the structural relationship between the contacts 41 and 44, are the same as those of the development roller contact 40 and development bias contact 43, and so are those of the development blade contact 42 and development blade bias contact 45. In terms of practicality, all that is necessary is that at least one of the electrical contacts mentioned above is structured as will be described next.

Referring to FIG. 10(*b*), the development bias contact 43 in the apparatus main assembly 100A comprises: a compression spring 43*a* for providing the pressure for keeping the development bias contact 43 in contact with the development roller contact 40; and a portion 43*b* which actually contacts the development roller contact 40. In other words, the development bias contact 43 is structured so that as the development bias contact 43 is placed in contact with (pressed upon) the development roller contact 40 of the process cartridge 7, a preset amount of contact pressure is generated between the development bias contact 43 and development roller contact 40 by the resiliency of the compression spring 43*a*. Further, the development bias contact 43 is provided with a portion 43*c* by which the development bias contact 40 contacts the high voltage circuit (unshown) to be supplied with electrical power.

Figure 11:
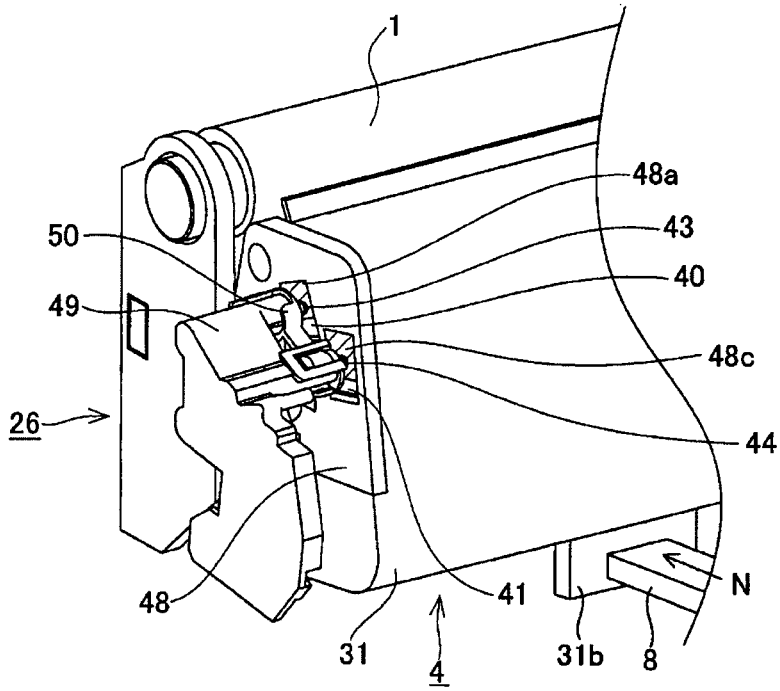
FIG. 11 is drawing for describing the electrical contacts of the process cartridge, and those of the main assembly of the image forming apparatus, in the first preferred embodiment of the present invention.
Figure 11:
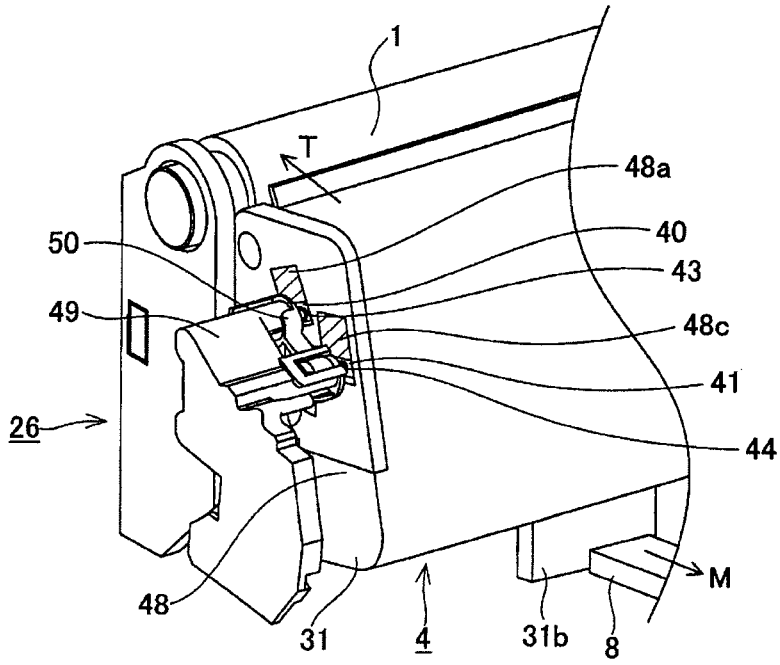

Next, the state of the process cartridge 7, in which the electrical contacts of the process cartridge 7 are in contact with the corresponding electrical contacts of the apparatus main assembly 100A, is described. FIG. 11(*a*) is a schematic perspective view of the process cartridge 7 when the development unit 4 is in the separation position. It is for describing the state of the electrical contacts of the process cartridge 7 and those of the apparatus main assembly 100A when the development unit 4 is in the separation position. FIG. 11(*b*) is a schematic perspective view of the process cartridge 7 when the development unit 4 is in the contact position. It is for describing the state of the electrical contacts of the process cartridge and those of the apparatus main assembly 100A when the development unit 4 is in the contact position. For the sake of convenience in terms of description, FIG. 11 does not show the rear plate 83.

Referring to FIG. 11(*a*), at the completion of the mounting of the process cartridge 7 into the apparatus main assembly 100A, the separation member 8 of the apparatus main assembly 100A is in contact with the separation force catching portion 31*b*, and the development unit 4 is in the separation position, that is, the position in which the development roller 25 is kept separated from the photosensitive drum 1. When the development unit 4 is in the separation position, the development bias contact 43 of the apparatus main assembly 100A is in contact with the area 48*a*, as the first electrical contact (hatched portion in drawing) of the process cartridge 7, which is on the outward surface of the side cover 48 of the peripheral surface 7. The toner supply roller bias contact 44 is in contact with the area 48*c* (hatched portion in drawing) of the side cover 48. Further, the development blade bias contact 45 is in contact with the unshown area of the side cover 48.

The apparatus main assembly 100A and process cartridge 7 are structured so that the area 48*a* is flat, and the plane of the area 48*a* of the side cover 48 is perpendicular to the direction in which the compression spring 43*a* of the development bias contact 43 is kept compressed. That is, the plane of the area is 48*a* is not parallel to the direction in which the pressure is applied to place the development roller 25 in contact with the photosensitive drum 1. In this embodiment, the area 48*a* is flat, and is perpendicular to the rotational axis of the development roller 25. Further, the area with which the toner supply roller bias contact 44 comes into contact, and the area with which the development blade bias contact 45 comes into contact, are similar to the area 48*a*.

Next, referring to FIG. 11(*b*), prior to the starting of an image forming apparatus, the separation member 8 is moved in the direction indicated by the arrow mark M, being thereby separated from the separation force catching portion 31*b*. Thus, the development unit 4 is rotationally moved in the direction indicated by the arrow mark T, being thereby placed in the contact position. Thus, the development roller 25 is placed in contact with the photosensitive drum 1. It is when the development unit 4 is in the contact position that the development roller contact 40 of the development unit 4, which is the second electrical contact of the development unit 4, is placed in contact with the development bias contact 43 to provide electrical connection between the two electrical contacts 40 and 43.

It should be noted here that because bias voltage has to begin to be applied to the development roller 25 before the development roller 25 comes into contact with the photosensitive drum 1, the development roller contact 40 is positioned so that it comes into contact with the development bias contact 43 while the development unit 4 is moved from the separation position to the contact position. If the development roller 25 comes into contact with the photosensitive drum 1 while bias voltage is not being applied to the development roller 25, it is liable that toner particles with no electrical charge might be transferred from the development roller 25 onto the photosensitive drum 1. This is why the image forming apparatus 100 and process cartridge 7 are structured so that the development bias contact 43 and development roller contact 40 come into contact with each other before the development roller 25 comes into contact with the photosensitive drum 1.

Figure 12:
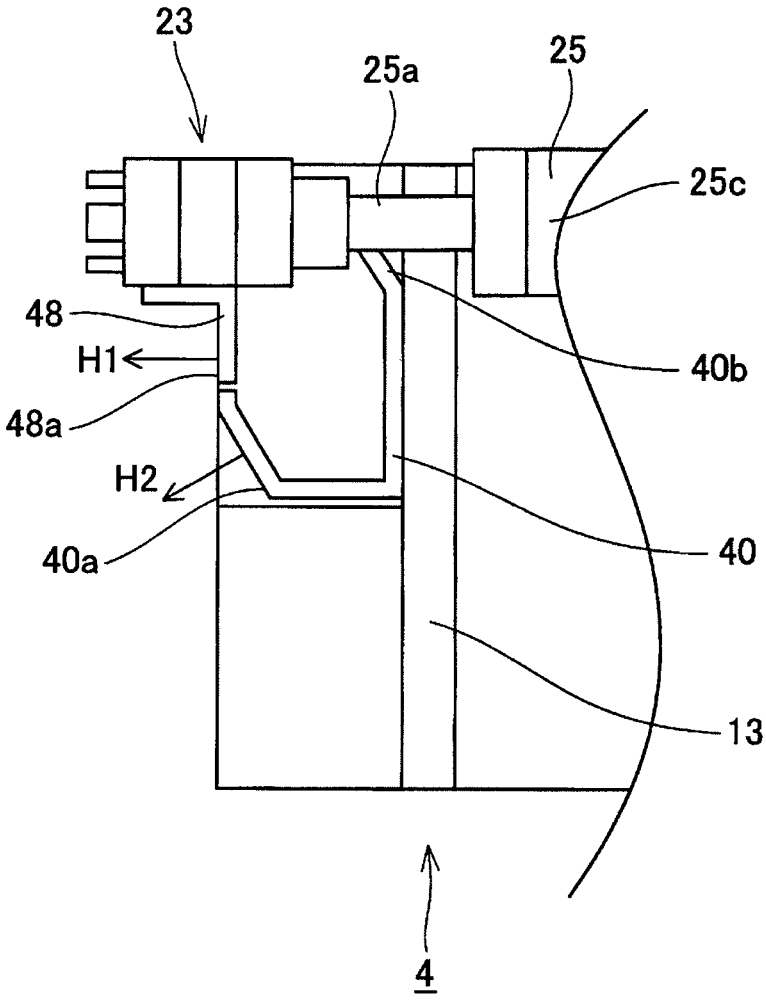
FIG. 12 is a drawing for describing the electrical contacts of the development roller, about their structure.

Next, the development roller contact 40 and side cover 48 of the process cartridge 7 are described about their structures. FIG. 12 is a schematic sectional view of one of the lengthwise end portions of the process cartridge 7, which is for describing the structure of the development roller contact 40 and the structure of the side cover 48. Referring to FIG. 12, the development roller 25 has a metallic core 25*a*, which is rotatably supported by the development roller bearings 13. One of the lengthwise ends of the metallic core 25*a* of the development roller 25 is fitted with an Oldham's coupling 23 through which driving force is transmitted to the development roller 25 from the apparatus main assembly 100A. The development roller contact 40 is on the rear development roller bearing 13. It has: an area 40*b*, by which it contacts the metallic core 25*a;* and an area 40*a*, as the second electrical contact of the developer roller contact 40, by which the developer roller contact 40 contacts the development bias contact 43.

The side cover 48 is provided with the area 48*a* of electrical contact of the process cartridge 7, on which the portion 43*b* of the development bias contact 43 slides. The process cartridge 7 is designed so that the normal line of the area 48*a* of electrical contact of the process cartridge 7 is parallel to the rotational axis 25*c* of the development roller 25, and also, so that the normal line H2 of the area 40*a* of the development roller contact 40 is angled relative to the normal line H1 of the area 48*a* of electrical contact (parallel to direction in which development unit 4 is moved from contact position to separation position).

Figure 1:
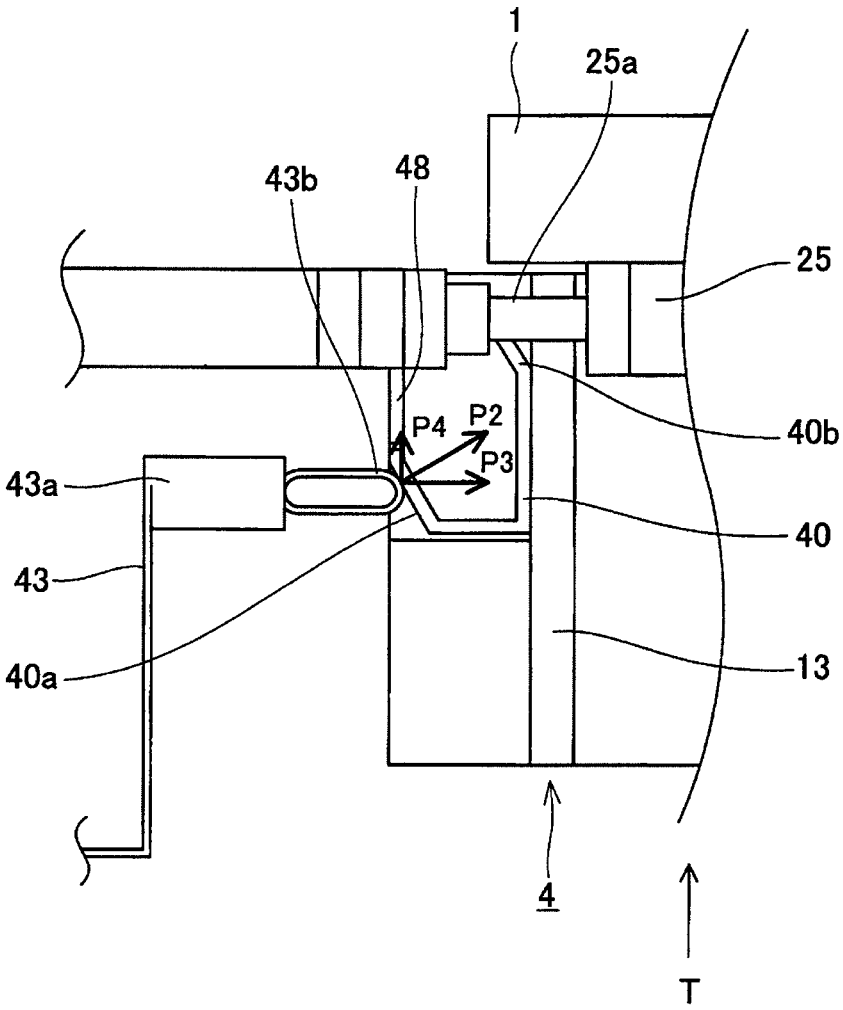
FIG. 1 is a drawing for describing the electrical contacts of the process cartridge, and the electrical contacts of the main assembly of the image forming apparatus, in the first preferred embodiment of the present invention.
Figure 13:
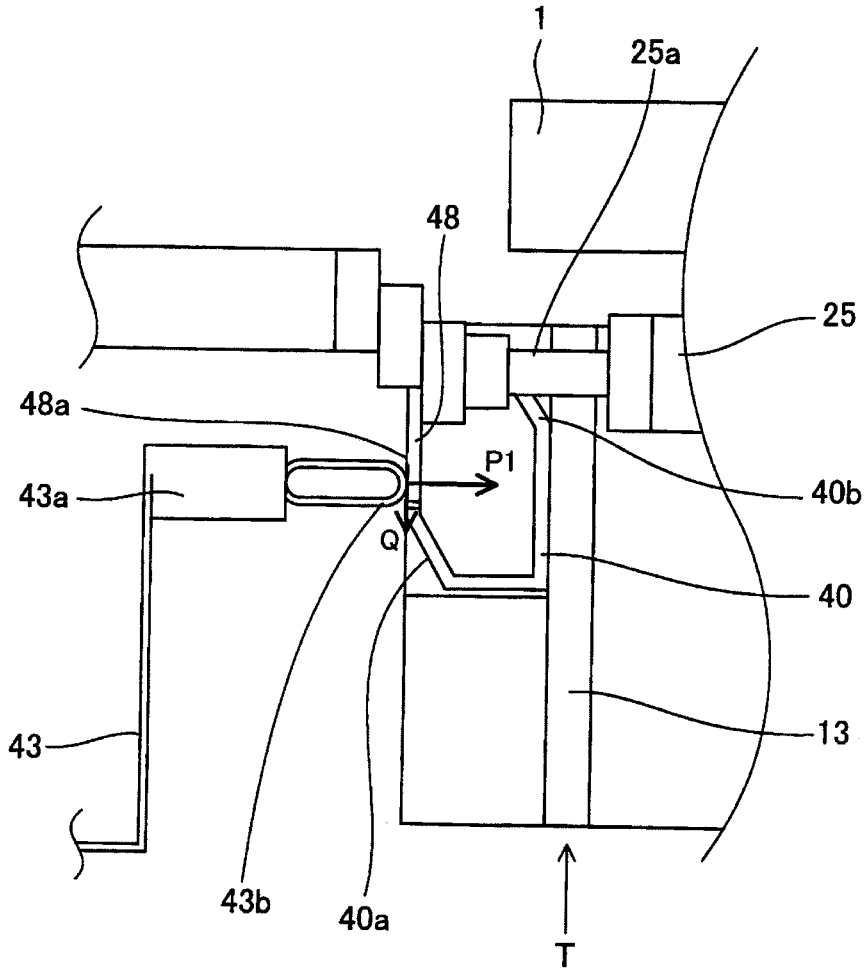
FIG. 13 is a drawing for describing the electrical contacts of the process cartridge, and those of the main assembly of the image forming apparatus, in the first preferred embodiment of the present invention.

Next, referring to FIGS. 13 and 1, the positional relationship between development bias contact 43 and development roller contact 40 when the development unit 4 is in the separation position, and the state of contact between the development bias contact 43 and development roller contact 40 when the development unit 4 is in the contact position, and the contact pressure which is present between the development bias contact 43 and development roller contact 40 when the development unit 4 is in the contact position, are described. FIG. 13 is a schematic sectional view of the electrical contacts of the process cartridge 7, electrical contacts of the apparatus main assembly 100A, and their adjacencies. It is for describing the electrical contacts. FIG. 1 is a schematic sectional view of the electrical contacts of the process cartridge 7, electrical contacts of the apparatus main assembly 100A, and their adjacencies. It is for describing the state of contact between the electrical contacts of the process cartridge 7 and the electrical contacts of the apparatus main assembly 100A.

Referring to FIG. 13, when the development unit 4 is in the separation position, that is, the position in which the development roller 25 is kept separated from the photosensitive drum 1, the area 48*a* of electrical contact is in contact with the portion 43*b* of the development bias contact 43, and is subjected to the contact pressure P1 generated between the portion 43*b* and area 438*a* by the resiliency of the compressed compression spring 43*a*. The direction of the contact pressure P1 does not coincide with the direction in which the development roller 25 is moved to be placed in contact with the photosensitive drum 1. That is, the process cartridge 7 is structured so that the direction of the contact pressure P1 to which the area 48*a* of electrical contact is subjected by the development bias contact 43 is not parallel to the direction (indicated by arrow mark T in drawings) in which the development unit 4 is moved from the separation position to the contact position.

In this embodiment, the direction of the contact pressure P1 is perpendicular to the lengthwise direction of the process cartridge 7 (rotational axis of development roller 25 and rotational axis of photosensitive drum 1), that is, the direction in which the development unit 4 is moved to place the development roller 25 in contact with the photosensitive drum 1. When the process cartridge 7 is not being used for image formation, the development unit 4 is kept in the separation position by the separation member 8 in the apparatus main assembly 100A. Since the contact pressure P1 which the development bias contact 43 generates is parallel to the lengthwise direction of the process cartridge 7, it is different in direction from the force applied for placing the development unit 4 development roller 25 in contact with the photosensitive drum 1. Therefore, the separation member 8 is not subjected to the contact pressure P1.

While the development unit 4 is moved from the separation position to the contact position, the development unit 4 remains in contact with the portion 43*b* of the development bias contact 43, creating thereby a frictional resistance Q. If the amount of force applied to place the development roller 25 in contact with the photosensitive drum 1 is relatively small, this friction resistance Q interferes with the movement of the development unit 4, making it impossible to ensure that the development roller 25 is placed in contact with the photosensitive drum 1. Thus, one of the characteristic features of this embodiment is that the area 40*a* of the development roller contact 40 is angled relative to the direction in which the development bias contact 43 comes into contact with the development unit 4 (area 40*a*). Therefore, when the development bias contact 43 comes into contact with the area 40*a* of the development roller contact 40, the effect of the frictional resistance Q which occurs between the development bias contact 43 and area 40*a* is significantly smaller than the effect of the comparable frictional resistance in any process cartridge in accordance with the prior art.

As described above, the area 40*a* of the development roller contact 40 is angled relative to the direction in which the development bias contact 43 comes into contact with the development unit 4 (area 40*a*). More specifically, the area 40*a* of the development roller contact 40 is angled so that the upstream end of the area 40*a*, in terms of the direction in which the development unit 4 is moved from the separation position to the contact position, is farther from the development bias contact 43 than the downstream end of the area 40*a*. Next, referring to FIG. 1, as the development bias contact 43 comes into contact, and presses on, the area 40*a* of the development roller contact 40 while the development unit 4 is moved from the separation position to the contact position, the area 40*a* of the development roller contact 40 is subjected to a contact pressure P2 from the development bias contact 43. A referential code P3 stands for a component of the contact pressure P2, the direction of which is parallel to the lengthwise direction of the process cartridge 7, and a referential code P4 stands for a component of the contact pressure P2, which is perpendicular to the component P3. In this embodiment, the component P4 is parallel to the direction in which the development roller 25 is moved to be placed in contact with the photosensitive drum 1.

That is, the process cartridge 7 is structured so that the component P4 of the contact pressure P2, to which the area 40*a* of the development roller contact 40 is subjected by the development bias contact 43 when the development roller 25 is placed in contact with the photosensitive drum 1 for image formation, is parallel to the direction in which the development roller 25 is moved to be placed in contact with the photosensitive drum 1. That is, the process cartridge 7 is structured so that the force to which the area 40*a* of the development roller contact 40 is subjected by the development bias contact 43 as the development bias contact 43 comes into contact with, and presses on, the area 40*a* of the development roller contact 40 while the development unit 4 is moved into the contact position, is parallel to the direction in which the development unit 4 is moved from the separation position to the contact position.

In a case where the area of the electrical contact of the development roller is parallel to the electrical contact portion of the side cover as in the case of a conventional process cartridge, it is liable that the development roller is prevented by the frictional resistance between the area of the electrical contact of the development roller, and the development bias contact, from being properly pressed upon the photosensitive drum. Further, in consideration of the frictional resistance between the area of the electrical contact of the development roller, and the spring of the development bias contact of the apparatus main assembly 10A, the spring with which the process cartridge is provided to press the development roller upon photosensitive drum has to be substantial in resiliency. However, if this spring is substantial in resiliency, the force to which the separation member for separating the development roller from the photosensitive drum is subjected when the development roller is separated from the photosensitive drum is substantial, making it necessary to increase the separation member in strength.

In this embodiment, however, the component P4 of the contact pressure P2 to which the area 40*a* of the development roller contact 40 is subjected by the development bias contact 43 of the apparatus main assembly 100A is utilized as an additional force for placing the development roller 25 in contact with the photosensitive drum 1. Therefore, the force applied to place the development roller 25 in contact with the photosensitive drum 1 is prevented from being substantially robbed by the friction resistance between the area 40*a* of the development roller contact 40 and the development bias contact 43. Further, the compression spring 38 and tension spring 39, which are necessary to keep the development roller 25 in contact with the photosensitive drum 1, may be substantially smaller in resiliency. Thus, the amount of the load to which the separation member 8 and separation force catching portion 31*b* are subjected when the photosensitive drum 25 is separated from the photosensitive drum 1 is smaller than in the case of a conventional image forming apparatus and process cartridge therefor. Therefore, it is unlikely for the process cartridge 7 to be deformed by the force from the compression spring 38 and the force applied by the separation member 8. Further, the strength required of the separation member 8 and process cartridge 7 is smaller.

Also in this embodiment, in order to prevent the development unit 4 from being moved from the separation position to the contact position by the contact pressure. P1 (FIG. 13) to which the area 48*a* of the side cover 48 is subjected by the development bias contact 43, the process cartridge is structured so that the area 48*a* of the side cover 48 is perpendicular to the rotational axis 25*c* of the development roller 25 (parallel to direction in which development unit 4 is moved from separation position to contact position). However, it is not mandatory that the process cartridge 7 is structured so that the area 48*a* is perpendicular to the rotational axis 25*c* of the development roller 25. That is, the process cartridge 7 may be structured so that the inclination of the area 48*a* of the side cover 48 relative to the direction in which the development unit 4 is moved from the contact position to the separation position, is gentler than the inclination of the area 40*a* of the development roller contact 40 relative to the moving direction of the development unit 4. Since the process cartridge 7 is structured as described above, the component of the contact pressure P1 between the development bias contact 43 and development roller contact 40, which works in the direction in which the development unit 4 is moved from the separation position to the contact position, is the smaller than the contact pressure P2 to which the area 40*a* is subjected by the development bias contact 43. Therefore, the separation member 8, which keeps the development unit 4 in the separation position is prevented from being subjected to the full force of contact pressure P1 while the development roller 25 is kept separated from the photosensitive drum 1.

To summarize, according to this embodiment, it is possible to minimize the amount of the load to which the separation member 8 is subjected by the development bias contact 43 while the image forming apparatus 100 is not being used for image formation, and also, to ensure that while the image forming apparatus 100 is being used for image formation, the development roller 25 is kept properly in contact with the photosensitive drum 1.

[Embodiment2]

Figure 16:
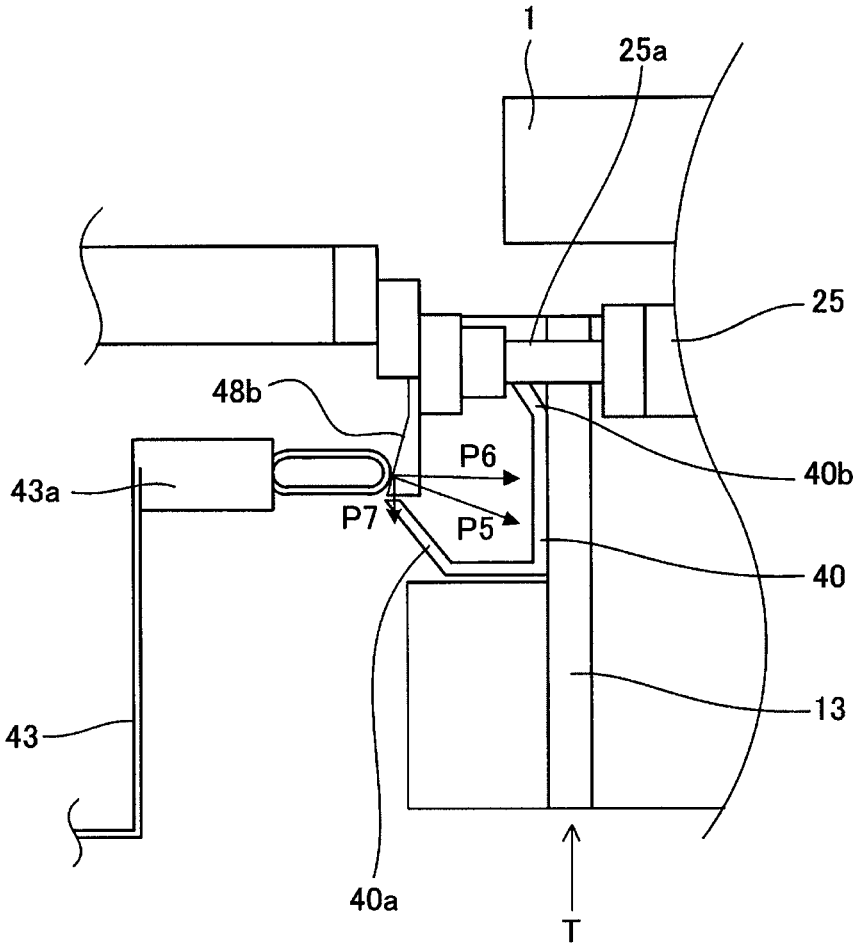
FIG. 16 is a drawing for describing the electrical contacts of the development roller in the second preferred embodiment of the present invention, about their structure.

Next, referring to FIG. 16, the second embodiment of the present invention is described. The components, portions, and the like, of the image forming apparatus and process cartridge in this embodiment, which are similar to the counterparts in the first embodiment are given the same referential codes as those given to the counterparts in the first embodiment, and will not be described here. FIG. 16 is a schematic sectional view of the electrical contacts of the process cartridge 7, electrical contacts of the apparatus main assembly 100A, and their adjacencies in this embodiment when the development unit 4 is in the separation position.

Referring to FIG. 16, the primary characteristic feature of this embodiment is that when the development unit 4 is in the separation position, that is, the position in which the development roller 25 is kept separated from the photosensitive drum 1, the compression spring 43*a* of the development bias contact 43 is in contact with the electrical contact area 48*b* of the side cover 48 of the process cartridge 7. The plane of the electrical contact area 48*b* is inclined relative to the direction in which the development unit 4 is moved be placed in contact with the development bias contact 43. That is, the area 48*b* is flat, and is inclined so that the downstream end of the area 48*b*, in terms of the direction in which the development unit 4 is moved from the separation position to the contact position, is farther from the upstream end of the area 48*b*. Therefore, the contact pressure P5, to which the area 48*b* is subjected by the development bias contact 43 when the development bias contact 43 comes into contact, and remains in contact, with the area 48*b* works in the direction parallel to the direction in which the development unit 4 is moved from the contact position to the separation position.

That is, the component P7 of the contact pressure P5, the direction of which is perpendicular to the component P6 of the contact pressure P5, the direction of which is parallel to the lengthwise direction of the process cartridge 7, is parallel to the direction in which the development roller 25 is separated from the photosensitive drum 1. Therefore, the contact pressure P5 to which the area 48*b* of electrical contact is subjected by the development bias contact 43 reduces the amount of the force which has to be applied to the process cartridge 7 by the separation member 8 (FIG. 7) to keep the development roller 25 separated from the photosensitive drum 1 when no image is being formed by the image forming apparatus 100.

On the other hand, the area 40*a* of the development roller contact 40 is inclined so that its upstream end in terms of the direction in which the development unit 4 is moved from the separation position to the contact position, is farther from the development bias contact 43 than its downstream end. That is, the force to which the area 40*a* of the development roller contact 40 is subjected by the development bias contact 43 when the development unit 4 is in the contact position works in the direction to keep the development roller 25 in contact with the photosensitive drum 1. Therefore, the image forming apparatus 100 and process cartridge 7 in this embodiment are smaller in the amount of the force (load) necessary to keep the development roller 25 separated from the photosensitive drum 1 when the image forming apparatus 100 is not forming an image, whereas they are more stable in the state of contact between the development roller 25 and photosensitive drum 1 when they are being used for image formation.

[Embodiment 3]

Figure 17:
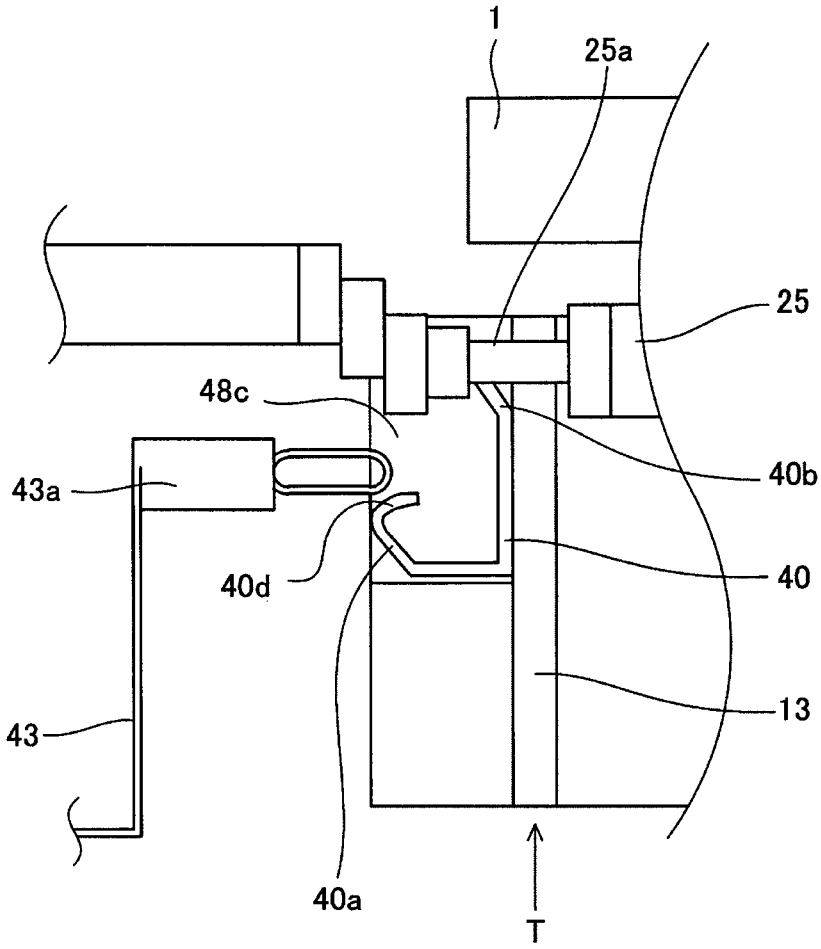
FIG. 17 is a drawing for describing the electrical contacts of the development roller in the third preferred embodiment of the present invention, about their structure.

Next, referring to FIG. 17, the third preferred embodiment of the present invention is described. The components, parts, etc. of the image forming apparatus and process cartridge in this embodiment, which are similar to the counterparts in the preceding embodiments are given the same referential codes as those for the counterparts, and are not described. FIG. 17 is a schematic sectional view of the electrical contacts of the process cartridge 7 and the electrical contacts of the apparatus main assembly 100A in this embodiment, when the development unit 4 is in the separation position.

The primary characteristic feature of this embodiment is that when the development unit 4 is in the separation position, that is, the position in which the development roller 25 is kept separated from the photosensitive drum 1, the compression spring 43*a* of the development bias contact 43 is not in contact with the process cartridge 7, as shown in FIG. 17.

More specifically, the side cover 48 of the development unit 4 has a recess 48*c*, which is positioned so that as the development unit 4 is moved into the separation position, the compression spring 34*a* of the development bias contact 43 enters the recess 48*c*, and therefore, does not come into contact with the process cartridge 7. Thus, it does not occur that when the development roller 25 is kept separated from the photosensitive drum 1, the separation member 8 is subjected to the force generated by the resiliency of the development bias contact 43. When the development unit 4 is moved from the separation position to the contact position, first, the compression spring 43*a* rides onto the bent portion 40*d* of the development roller contact 40. Then, as the development unit 4 is moved further toward the contact position, the compression spring 43*a* comes into contact with the area 40*a* of the development roller contact 40. Thus, as the development unit 4 is moved further toward the contact position, the development unit 4 is pressed toward the contact position by the development bias contact 43. Therefore, it is ensured that the development unit 4 places the development roller 25 in contact with the photosensitive drum 1, and keeps the development roller 25 in contact with the photosensitive drum 1.

Incidentally, the gist of this embodiment is that when the development unit 4 is in the separation position, the development bias contact 43 is not in contact with the development unit 4. Thus, the side cover 48 may be provided with a through hole or the like, instead of the recess 48*c*.

[Embodiment 4]

Figure 14:
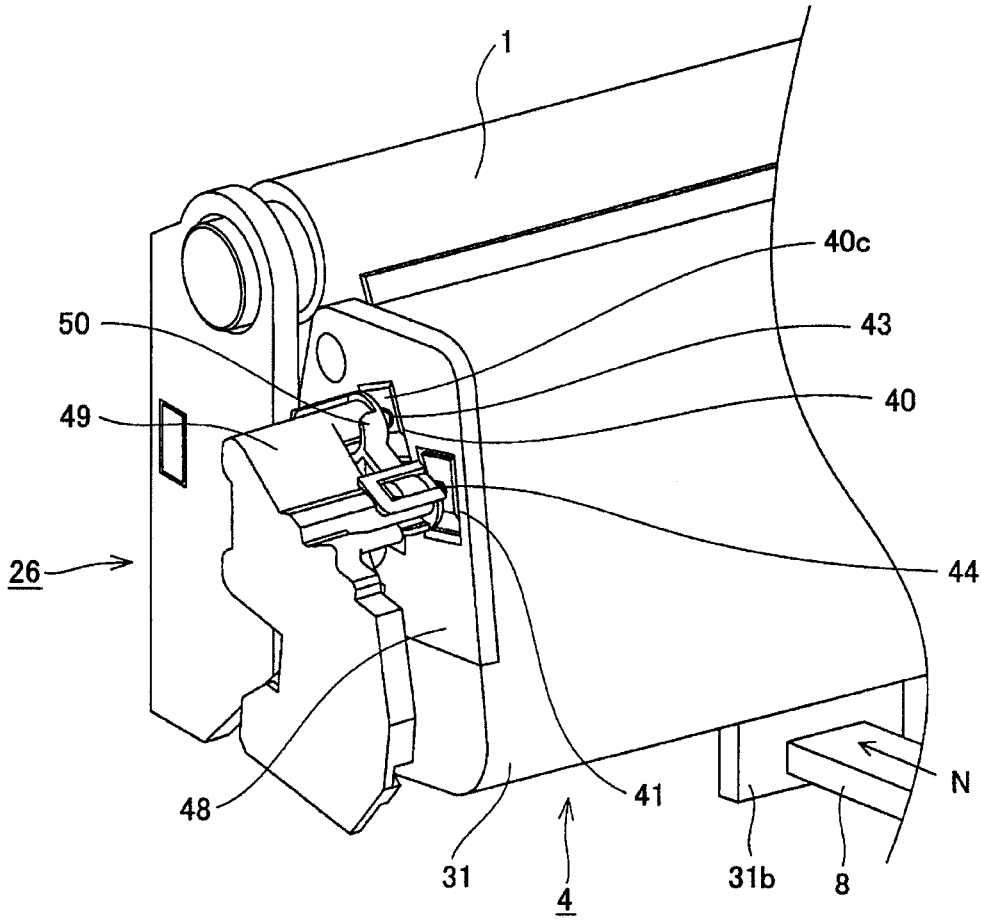
FIG. 14 is a drawing for describing the electrical contacts of the process cartridge, and those of the main assembly of the image forming apparatus, in the fourth preferred embodiment of the present invention.
Figure 15:
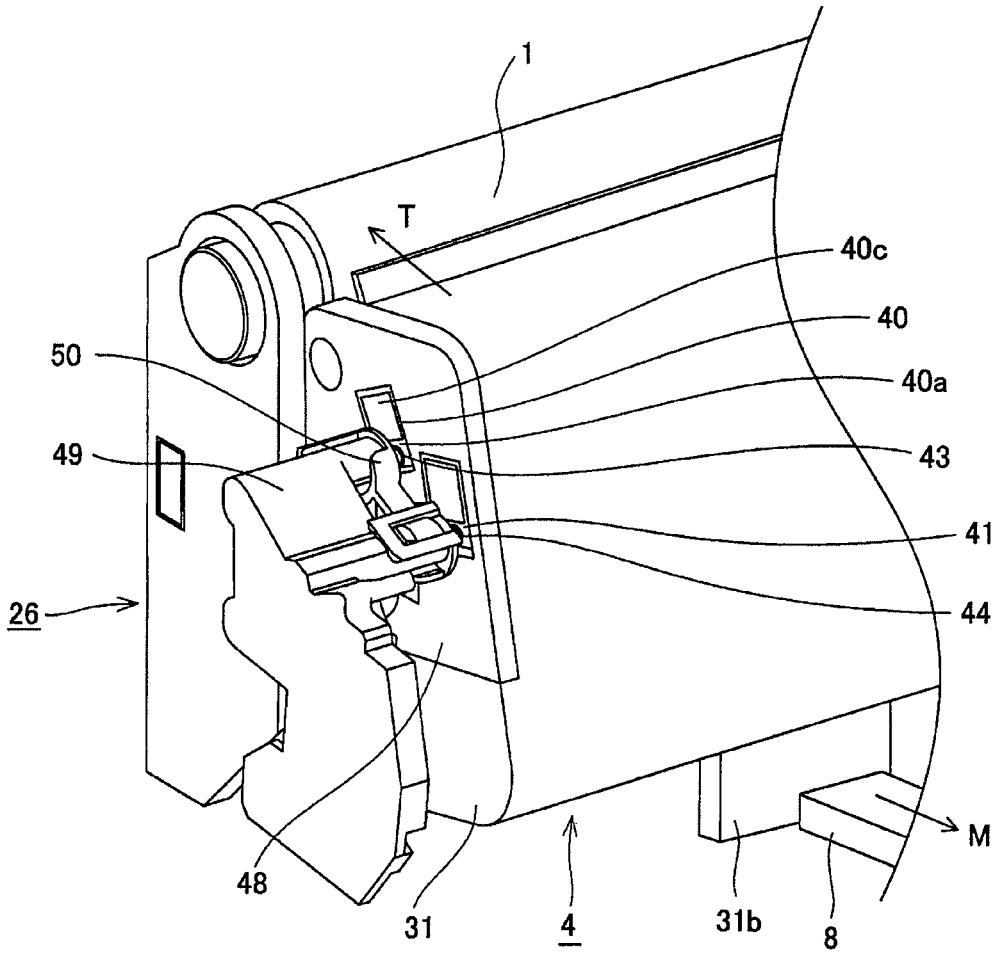
FIG. 15 also is a drawing for describing the electrical contacts of the process cartridge, and those of the main assembly of the image forming apparatus, in the fourth preferred embodiment of the present invention.

Next, the fourth preferred embodiment of the present invention is described with reference to FIGS. 14 and 15. FIG. 14 is a schematic perspective view of the electrical contacts of the process cartridge 7 and the electrical contacts of the apparatus main assembly 100A in this embodiment when the development unit 4 is in the separation position. FIG. 15 is a schematic perspective view of the electrical contacts of the process cartridge 7 and the electrical contacts of the apparatus main assembly 100A in this embodiment when the development unit 4 is in the contact position. This embodiment is described only about the structural components, parts, etc., of the image forming apparatus and process cartridge in this embodiment, which are different from the counterparts in the first embodiment. Those which are similar to the counterparts in the first embodiment are not going to be described.

Figure 18:
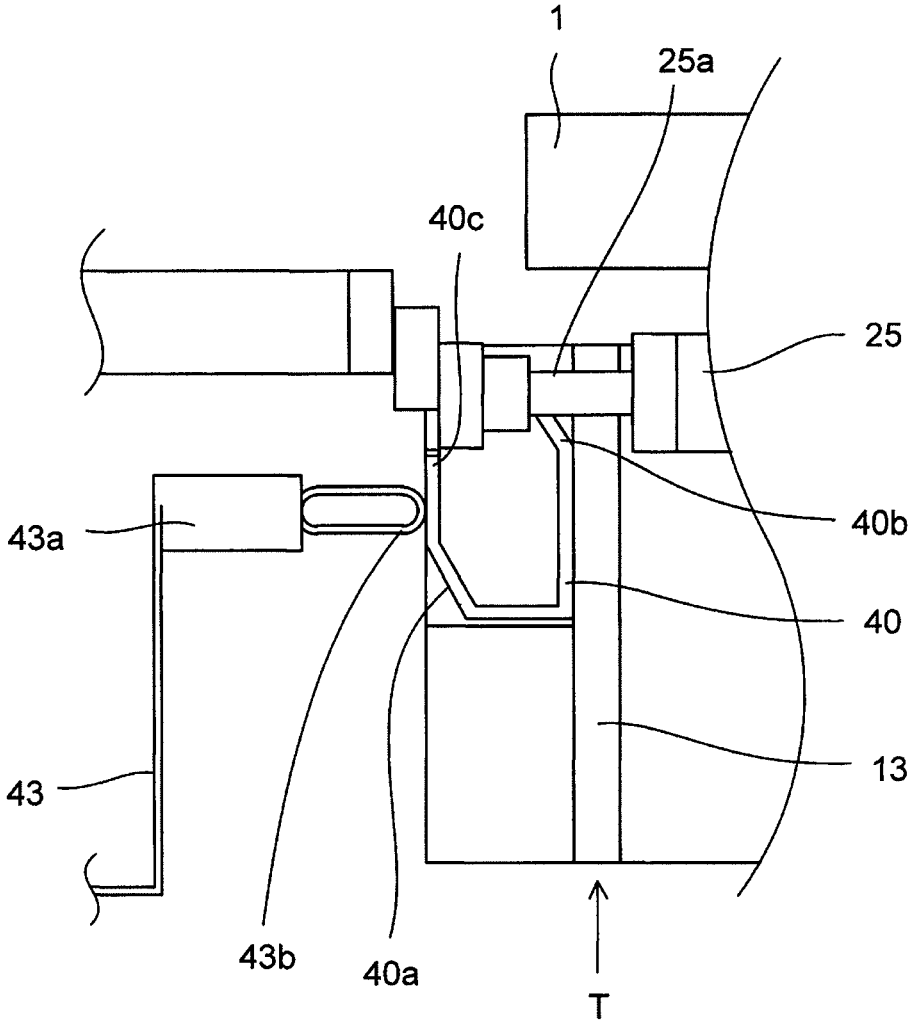
FIG. 18 is a drawing for describing the electrical contacts of the development roller in the fourth preferred embodiment of the present invention, about their structure.

The image forming apparatus 100 and process cartridge 7 in the first embodiment described above are structured so that when the development unit 4 is in the separation position, that is, the position in which it keeps the development roller 25 separated from the photosensitive drum 1, the development bias contact 43 is in contact with the area 48*a* of the side cover 48. Referring to FIG. 14, in comparison, in this embodiment, when the development unit 4 is in the separation position, that is, the position in which it keeps the development roller 25 separated from the photosensitive drum 1, the development bias contact 43 is in contact with the area 40*c* (first area of contact) of the development roller contact 40. More concretely, in this embodiment, the development roller contact 40, which is one of the components which can be placed in electrical connection to the development bias contact 43, is provided with an area 40*c* (as first area of electrical contact) and an area 40*a* (second area of electrical contact). The area 40*c*, which is shown in FIG. 18, is flat and perpendicular to the rotational axis of the development roller 25 like the area 48*a* of the side plate 48 in the first preferred embodiment.

Referring to FIG. 15, at the starting of an image forming operation, the development unit 4 is rotationally moved in the direction indicated by the arrow mark T in order to place the development roller 25 in contact with the photosensitive drum 1. While the development unit 4 is rotationally moved, the development bias contact 43 comes into contact with the area 40*c* of the development roller contact 40, and slides on the area 40*c*. Then, right before the completion of the rotational movement of the development unit 4, the development bias contact 43 comes into contact with the area 40*a* of the development roller contact 40. However, bias voltage has to be applied to the development roller 25 before the development roller 25 comes into contact with the photosensitive drum 1 as described before, for the reason that if the development roller 25 comes into contact with the photosensitive drum 1 when bias voltage is not being applied to the development roller 25, it is liable that the toner particles with no electrical charge may be transferred from the development roller 25 onto the photosensitive drum 1.

In this embodiment, however, the development bias contact 43 and development roller contact 40 are in contact with each other even when the development unit 4 is in the separation position. Therefore, a certain amount of latitude can be afforded for the timing with which bias voltage has to be applied to the development roller 25. That is, this embodiment also can provide the same effects as those which can be provided by the first embodiment. Moreover, this embodiment ensures better than the first embodiment, that the toner particles with no electrical charge are not transferred from the development roller 25 onto the photosensitive drum 1.

Although in this embodiment, in order to prevent the development unit 4 from being moved to the contact position by the contact pressure which the area 40*c* of the development roller contact 40 receives from the development bias contact 43, the area 40*c* is made perpendicular to the rotational axis of the development roller 25. This setup, however, is not mandatory. That is, all that is necessary is that, relative to the direction in which the development unit 4 is moved from the separation position to the contact position, the inclination of the area 40*a* is gentler than the inclination of the area 40*c*.

That is, the area 40*c* of the development roller contact 40 may be inclined so that in terms of the direction in which the development unit 4 is moved from the separation position to the contact position, the downstream end of the area 40*c* is farther from than development bias contact 43 than the upstream end of the area 40*c*. In this embodiment, therefore, the amount of the force applied to the area 40*c* by the development bias contact 43 works in the same direction as the direction in which the development unit 4 is moved from the contact position to the separation position. Thus, this embodiment can reduce the amount of the force necessary to be applied to the process cartridge 7 by the separation member 8 (FIG. 7) to separate the development roller 25 from the photosensitive drum 1.

[Miscellaneous Embodiments]

In each of the preferred embodiments of the present invention, four process cartridges were used. However, the preceding embodiments are not intended to limit the present invention in process cartridge count. That is, the process cartridge count may be set as necessary. Also in the preceding embodiments, the image forming apparatus was a printer. However, the preceding embodiments are not intended to limit the present invention in terms of the image forming apparatus to which the present invention is applicable. That is, the present invention is applicable to various image forming apparatuses other than a printer. For example, the present invention is applicable to a copying machine, a facsimile machine, etc., and a multifunction image forming apparatus capable of performing two or more functions of the preceding machines. Also in the preceding preferred embodiments, the image forming apparatus was such an image forming apparatus that employs an intermediary transfer member; transfers multiple monochromatic toner images, different in color, onto the intermediary transferring member; and transfers all at once the multiple monochromatic toner images from the intermediary transfer member onto recording medium. However, these preferred embodiments are not intended to limit the present invention in terms of the image forming apparatus to which the present invention is applicable. For example, the present invention is also applicable to an image forming apparatus which employs a recording medium bearing member, and sequentially transfers multiple monochromatic toner images, different in color, onto the recording medium borne on the recording medium bearing member. The application of the present invention to these image forming apparatuses other than those in the preceding preferred embodiments provides the same effects as those provided by the preferred embodiments.

Further, the preceding preferred embodiments were described with reference to the structure of the development roller contact 40, structure of the development bias contact 43, and the positional relationship between the development roller contact 40 and development bias contact 43. However, the preferred embodiments are not intended to limit the present invention in scope. That is, the present invention is applicable to other electrical contact (connection) between the process cartridge 7 and apparatus main assembly 100A than between the development roller contact 40 and development bias contact 43, as effectively as in the preferred embodiments. In a case where each of the process cartridge 7 and apparatus main assembly 100A has multiple (two) electrical contacts through which electrical connection is made between the process cartridge 7 and 100A, it is desired that the process cartridge 7 is provided with the first and second areas (points) of electrical contact, which correspond to the multiple (two) electrical contacts of the apparatus main assembly 100A, one for one.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 112208/2010 and 097427/2011 filed May 14, 2010 and Apr. 25, 2011, respectively, which are hereby incorporated by reference.

What is claimed is:

1. A process cartridge detachably mountable to a main assembly of an image forming apparatus, said process cartridge comprising:

a first unit provided with an image bearing member; and a second unit which is provided with a developer carrying member for carrying a developer and which is connected with said first unit so as to be movable between a contact position in which said developer carrying member is contacted with said image bearing member and a spacing position in which said developer carrying member is spaced from said image bearing member, and said second unit including a first contact portion for contacting to a main assembly electrical contact provided in the main assembly of the apparatus and for receiving a first contact force therefrom when said process cartridge is mounted to the main assembly of the apparatus and said second unit is positioned in the spacing position, and a second contact portion for contacting to the main assembly electrical contact and for receiving a second contact force therefrom, to electrically connect with the main assembly electrical contact when said process cartridge is mounted to the main assembly of the apparatus and said second unit is positioned in the contact position, wherein the second contact force has a component oriented in a moving direction of moving said second unit away from the spacing position toward the contact position, and the component is greater than a component of the first contact force.

2. The process cartridge according to claim 1, wherein said first contact portion and said second contact portion are disposed at an end of said second unit with respect to a longitudinal direction of said developer carrying member.

3. The process cartridge according to claim 1, wherein said second contact portion has a surface so inclined that the second contact force has the component in the moving direction.

4. The process cartridge according to claim 1, wherein said first contact portion has a surface so inclined that the first force does not have a component in the moving direction.

5. The process cartridge according to claim 1, wherein said first contact portion has a surface so inclined that the first force has a component in a direction opposite the moving direction.

6. The process cartridge according to claim 1, wherein said first contact portion and said second contact portion are parts of an electrical contact member electrically connectable with the main assembly electrical contact.

7. The process cartridge according to claim 1, wherein said second contact portion is electrically connectable to said developer carrying member.

8. The process cartridge according to claim 1, further comprising a developer feeding member for supplying the developer to said developer carrying member, and said second contact portion is electrically connected with said developer feeding member.

9. The process cartridge according to claim 1, further comprising a developer amount regulating member for regulating an amount of the developer carried on said developer carrying member, and said second contact portion is electrically connected with said developer amount regulating member.

10. The process cartridge according to claim 1, wherein said second unit includes a plurality of such second contact portions corresponding to such main assembly electrical contacts provided in the main assembly of the apparatus.

11. An image forming apparatus to which a process cartridge is detachably mountable, wherein said process cartridge includes a first unit provided with an image bearing member and a second unit which is provided with a developer carrying member for carrying a developer and which is connected with said first unit so as to be movable between a contact position in which said developer carrying member is contacted with said image bearing member and a spacing position in which said developer carrying member is spaced from said image bearing member, said apparatus comprising:

a main assembly electrical contact for contacting to and applying a first contact force to a first contact portion provided in said second unit when said second unit is in the spacing position, and for contacting to and applying a second contact force to a second contact portion provided in said second unit to electrically connect with said second contact portion, wherein the second contact force has a component oriented in a direction of moving said second unit away from the spacing position toward the contact position, and the component is greater than a component of the first contact force.

12. The image forming apparatus according to claim 11, wherein said first contact portion and said second contact portion are disposed at an end of said second unit with respect to a longitudinal direction of said developer carrying member.

13. The image forming apparatus according to claim 11, wherein said first contact force does not have a component in the moving direction.

14. The image forming apparatus according to claim 11, wherein the first contact force is has a component oriented in a direction of moving said second unit away from said contact position toward said spacing position.

15. The image forming apparatus according to claim 11, wherein said first contact portion and said second are parts of an electrical contact member electrically connectable with the main assembly electrical contact.

16. The image forming apparatus according to claim 11, wherein said main assembly electrical contact is capable of applying a voltage to said developer carrying member.

17. The image forming apparatus according to claim 11, wherein said process cartridge includes a developer feeding member for supplying the developer to said developer carrying member, and said second contact portion is electrically connected with said developer feeding member.

18. The image forming apparatus according to claim 11, wherein said process cartridge includes a developer amount regulating member for regulating an amount of the developer carried on said developer carrying member, and said second contact portion is electrically connected with said developer amount regulating member.

19. The image forming apparatus according to claim 11, wherein said image forming apparatus includes a plurality of such main assembly electrical contacts correspondingly to a plurality of such second contact portions.

* * * * *